US006113215A

United States Patent [19]

Yanagi et al.

[11] Patent Number: 6,113,215

[45] **Date of Patent: *Sep. 5, 2000**

[54] RECORDING APPARATUS WITH AN INK TANK USEFUL FOR HAVING SAID RECORDING APPARATUS, AND AN INFORMATION PROCESSING EQUIPMENT HAVING SAID RECORDING APPARATUS

[75] Inventors: Haruyuki Yanagi, Machida; Tetsuo Suzuki, Yokohama; Masahiro Taniguro, Yokohama; Hiroyuki Saito, Yokohama; Takeji Niikura; Koichi Tanno, both of Kawasaki; Makoto Kawarama, Ayase; Hiroyuki Kinoshita, Kawasaki; Masaya Shinmachi, Kawasaki; Tan At Ming, Kawasaki, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/956,761

[22] Filed: Oct. 22, 1997

Related U.S. Application Data

[63] Continuation of application No. 08/757,898, Nov. 27, 1996, abandoned, which is a continuation of application No. 08/293,432, Aug. 22, 1994, abandoned.

[30] Foreign Application Priority Data

| | | | |
|---|---|---|---|
| Oct. 29, 1993 | [JP] | Japan | 5-272699 |
| Jan. 25, 1994 | [JP] | Japan | 6-006594 |
| Aug. 4, 1994 | [JP] | Japan | 6-183481 |

[51] Int. Cl.[7] ..... B41J 2/01

[52] U.S. Cl. ..... 347/49

[58] Field of Search ..... 347/49, 50

[56] References Cited

U.S. PATENT DOCUMENTS

| | | | |
|---|---|---|---|
| 4,313,124 | 1/1982 | Hara | 347/57 |
| 4,345,262 | 8/1982 | Shirato et al. | 347/10 |
| 4,459,600 | 7/1984 | Sato et al. | 347/47 |
| 4,463,359 | 7/1984 | Ayata et al. | 347/56 |
| 4,558,333 | 12/1985 | Sugitani et al. | 347/65 |
| 4,608,577 | 8/1986 | Hori | 347/66 |
| 4,723,129 | 2/1988 | Endo et al. | 347/56 |
| 4,740,796 | 4/1988 | Endo et al. | 347/56 |
| 5,138,342 | 8/1992 | Kurata et al. | 347/50 |
| 5,182,581 | 1/1993 | Kashimura et al. | 347/87 |
| 5,212,502 | 5/1993 | Bowling | 347/49 |
| 5,216,448 | 6/1993 | Unosawa et al. | 347/49 |
| 5,245,361 | 9/1993 | Kashimura et al. | 347/50 |
| 5,245,362 | 9/1993 | Iwata et al. | 347/23 |

FOREIGN PATENT DOCUMENTS

| | | | |
|---|---|---|---|
| 20376719 | 7/1990 | European Pat. Off. . | |
| 20379151 | 7/1990 | European Pat. Off. . | |
| 54-056847 | 5/1979 | Japan . | |
| 59-123670 | 7/1984 | Japan . | |
| 59-138461 | 8/1984 | Japan . | |
| 60-071260 | 4/1985 | Japan . | |
| 262651 | 12/1985 | Japan | 347/49 |
| 178051 | 7/1990 | Japan | 347/49 |
| 133742 | 5/1992 | Japan | 347/49 |
| 5278300 | 10/1993 | Japan . | |

*Primary Examiner*—Valerie Lund
*Attorney, Agent, or Firm*—Fitzpatrick, Cella, Harper & Scinto

[57] ABSTRACT

A recording apparatus capable of making the image formation without reduction in recording quality is embodied. The recording apparatus comprises holding means for detachably holding a recording head for forming image on the recording medium, and positioning means for positioning the recording head at a predetermined position of the holding means in mounting the recording head on said holding means, characterized in that the positioning means has a first fitting meand for restraining the recording head in a first direction, and a second fitting means for restraining the recording head in a second direction, wherein restraining means is provided for fitting the second fitting means prior to the first fitting means in mounting the recording head on the holding means.

51 Claims, 20 Drawing Sheets

RECORDING APPARATUS WITH AN INK TANK USEFUL FOR HAVING SAID RECORDING APPARATUS, AND AN INFORMATION PROCESSING EQUIPMENT HAVING SAID RECORDING APPARATUS

This is a continuation of application Ser. No. 08/757,898 filed Nov. 27, 1996 now abandoned, which is a continuation of application Ser. No. 08/293,432 filed Aug. 22, 1994 now abandoned.

BACKGROUND OF THE INVENTION

1. Field of the Invention

The present invention relates to a recording apparatus having recording means for outputting input information such as characters or image onto the recording medium, and an information processing system having said recording apparatus as output means, such as a copying machine, a facsimile, a printer, a word processor, and a personal computer.

2. Related Background Art

Conventionally, recording apparatuses which perform the recording on the recording medium (hereinafter simply referred to as the recording sheet) such as paper, clothe plastic sheet, OHP sheet, etc., have been proposed in the form capable of mounting a recording head of various recording systems including, for example, wire dot system, thermal system, thermal transfer system, and ink jet system.

Amount such recording apparatuses, a recording apparatus comprising a recording head of the ink jet system in which the recording is performed on the recording sheet by discharging the ink through discharge ports (nozzles) arranged on the recording elements (hereinafter referred to as an ink jet recording apparatus), known as the non-impact recording with low noise, can attain high density and fast recording operation.

The ink jet recording apparatus takes the configuration corresponding to the specific functions or service conditions of the system to which the apparatus is applied. Typically, the ink jet recording apparatus comprises a carriage having a recording head and an ink tank mounted thereon, conveying means for conveying the recording sheet, and control means for controlling them.

And the recording head for discharging ink droplets through a plurality of discharge ports is scanned serially in a direction (main scan direction) orthogonal to a conveying direction (sub-scan direction) of the recording sheet, while the recording sheet is conveyed intermittently (pitch feed) by an amount equal to the recording width when not recording. By using the recording head having a number of nozzles for discharging the ink arranged linearly in the sub-scan direction, the recording can be performed for a width corresponding to the number of nozzles every time the recording head scans once over the recording sheet.

Also, the ink jet recording apparatus has the low running cost, can be made more compact, and is easy to deal with the color image recording by using color inks. In particular, a recording apparatus of the line type using recording means of the line type having a number of discharge ports arranged in the width direction of the recording sheet has the capability of the faster recording.

From the above reasons, the ink jet recording apparatus has been utilized and produced on a commercial scale as output means of the information processing system, for example, a printer useful for a copying machine, a facsimile, an electronic typewriter, a word processor, an output terminal such as a workstation, or a handy or portable printer provided in a personal compubter, a host computer, an optical disk unit, or a video device.

The recording elements of the ink jet recording means, i.e., energy generating means for generating the energy to discharge the ink, may include those of using an electromechanical converter such as a piezo-electric element, those of directing radiation of electromagnetic wave such as a laser to generate heat, and discharge liquid droplets by the action of that heat, and those of heating the liquid by the employment of electricity-heat converting element having a heating resistor.

Among them, a recording head of the ink jet recording system of discharging the liquid by the use of heat energy can perform the recording with high resolution, because the liquid discharge ports can be arranged at high density. In particular, a recording head using electricity-heat converting element as energy generating means is beneficial, because the recording head can be easily made more compact, can make more effective use of the merits of the IC technology or micro-process technology which has found remarkable progress of the technology and improved reliability in the recent semiconductor field, is easy to make high density packaging, and have the low manufacturing cost.

An ink tank for supplying the ink to the recording head is substantially comprised of an ink absorbing member, a vessel within which the ink absorbing member is accommodated, and a lid member for sealing the vessel.

The recording head as above described has two types including a chip type of having an ink tank integrally formed therewith and a type of having an ink tank detachably coupled. In either case, the positioning between the recording head and the ink tank, or the positioning between the head cartridge having these members integrated and the carriage, is an important item relating to the print quality. One of such positioning means employs a fit hole and a fit pin, thereby allowing for the positioning correctly.

It is to be noted that the recording apparatus on which the head cartridge is mounted has a head recovery device as described below to protect the recording head.

First, the head recovery device will be described.

The head recovery device is disposed at one end of the movement passage of the recording head, e.g., at a site opposed to a home position. The head recovery device is operated by the driving force of a motor via a transmission mechanism to make the capping of the recording head. Ink suction (suction recovery) is performed by appropriate suction means (e.g., a suction pump) provided within the head recovery device in connection with the capping of the recording head with a cap portion of the head recovery device, thereby performing a discharge recovery processing of removing the thickened ink within the discharge ports by compulsorily discharging the ink through the discharge ports. Also, the recording head is protected by making the capping after the completion of the recording. Such discharge recovery processing may be performed when the power is turned on, when the recording head is replaced, and when the recording operation is interrupted beyond a fixed time.

Next, a wiping unit will be described.

The wiping unit is disposed on the side face of the head recovery device, and has a blade as a wiping member formed of silicone rubber. The blade is held in a cantilevered form by a blade holding member, and activated by the motor as well as the transmission mechanism, like the head recovery device, to be engageable with the discharge face of the recording head. Thus, at an appropriate timing in the recording operation of the recording head, or after the discharge recovery processing using the head recovery device, the blade is protruded into the movement passage of the recording head to wipe off the dew, the wet or the dust on the discharge face of the head along with the movement of the head.

In this way, the ink jet recording apparatus can stabilize the ink discharge performance by using the head recovery device and the wiping unit. Accordingly, in mounting or demounting such a member (e.g., a head cartridge having the recording head and the ink tank integrated) on or from the carriage, it is necessary to take care not to place the nozzle face of the recording head into contact with the recovery device or the platen to deform the recording head or the recovery device, as well as other members.

The following constructions of mounting the head cartridge are provided including:

(1) Directly pressing a flexible cable within the carriage.

(2) Providing a recess portion for receiving the flexible cable within the head cartridge and mounting the head cartridge in the proximity of the carriage.

(3) Using a carriage having the flexible cable attached, movable up and down, to mount the head cartridge by moving up the carriage, and secure it therein by lowering the carriage to make the printing.

In any way, it is important for the high printing accuracy to secure physically the electrical contact between the flexible cable and the head cartridge, and to position the head cartridge with the carriage at high precision and reliably.

In the recent ink jet recording apparatuses, an ink tank of large capacity to allow for a great amount of recording is often used as a replacement tank. When a head cartridge having such ink tank is used, a mounting structure of turning the ink tank about a first positioning member into abutment with a second positioning member is often utilized to effect the easy coupling and the correct positioning.

However, the above conventional recording apparatus may cause a deformation or breakage of the recording head due to the problems on the construction as described below, even if the user carefully performs the coupling operation of the head cartridge.

One of the problems is that no appropriate coupling means conforming with the structure of the ink jet cartridge to be mounted is provided on the recording apparatus main unit.

In order to avoid such deformation as above mentioned, it is conceived that the head coupling position may be provided outside the cap position and the recording area, but it is required to make the apparatus size larger from the necessity of reserving a space thereof, opposed to the requirement of compact apparatus. On the other hand, if the head replacement position is provided within the recording area, there was a risk that the top end (face plane) of the recording head might rub against the guide of recording sheet conveying means, upon coupling the recording head, because the distance from the nozzle top end of the recording head to the recording surface of the recording sheet is as narrow as about 1 mm to 2 mm to assure the recording image quality. In this case, the recording quality may be degraded if the head face plane is damaged.

In the construction of mounting the head cartridge by directly pressing a flexible cable within the carriage, or by turning the head cartridge, there was the problem that the flexible cable might be damaged due to friction, and the flexible cable be worn. This problem will also occur in the head cartridge of the type providing a recess portion for receiving the flexible cable within the head cartridge and mounting the head cartridge in proximity of the carriage, due to friction between the recess portion and the flexible cable.

In the construction of having a carriage having the flexible cable attached, movable up and down, to mount the head cartridge by moving up the carriage, and secure it therein by lowering the carriage to make the printing, there is a problem that the mechanism becomes more complex, and the apparatus is larger in size.

SUMMARY OF THE INVENTION

The present invention has been achieved in the light of the aforementioned problems associated with the conventional art, and its objective is to provide a recording apparatus for making image formation and an information processing system having said recording apparatus as output means, wherein the electrical contact between the recording head and the carriage can be securely made, and the carriage can be attached or detached without rubbing of the face plane of the recording head against the guide face of recording sheet conveying means, whereby the recording quality is assured.

A recording apparatus of the present invention having holding means for detachably holding a recording head for forming image on the recording medium, and positioning means for positioning said recording head at a predetermined position of said holding means in mounting said recording head on said holding means, characterized in that said positioning means has a first fitting means for restraining said recording head in a first direction, and a second fitting means for restraining said recording head in a second direction, and restraining means for fitting said second fitting means prior to said first fitting means in mounting said recording head on said holding means is provided.

In this case, each of said fitting means may be comprised of a fit pin and a fit hole.

When above constituted, said fit pin may be of a tapered shape.

In any one of the above recording apparatuses of the present invention, said restraining means may be a projection extending from said holding means so that said recording head may be tilted in a sense closer to said second fitting means than said first fitting means by the abutment against said recording head.

In this case, pressing means for pressing said recording head against said projection may be provided at a position opposed to said projection.

In any one of the above recording apparatuses of the present invention, said projection may be out of contact with said recording head in the state in which said recording head is positioned at a predetermined position of said holding means.

Further, said restraining means may be urging means for urging said recording head toward said second fitting means.

The recording apparatus with any one of the above constructions comprises a carriage for carrying said recording means thereon, coupler means for coupling or decoupling recording means at a predetermined replacement position of said holding means, and electrical contact means for transmitting an electric signal to said recording means upon making contact with an electrical contact surface of said recording means mounted on said carriage, characterized in that said coupler means comprises a holding member for holding said recording means to move in a predetermined direction to cause said positioning means and said recording means to be contacted and cause said recording means to be mounted on said carriage, and said holding member comprises an arm for detachably holding said recording means, and positioning means for placing said recording means at a predetermined position on the holding member.

In this case, the movement direction of said holding means may be perpendicular to a direction of mounting said recording means.

Further, means for covering said contact means and said positioning means from the direction of mounting said recording means may be provided.

Further, pressure means for pressing said recording means in a predetermined direction may be provided on the plane of said carriage opposed to said contact means and said positioning means.

In this case, said pressure means may press at least one site within a polygonal area formed by connecting a plurality of points in which said positioning means is provided.

Also, said pressure means may be comprised of a plurality of pressure means including rigid pressure means and elastic pressure means.

Also, said positioning means corresponding to a positioning fit hole provided on said recording means may be a tapered fit pin having a predetermined fit dimension at a positioning site of said recording means.

In this case, means for contacting a part of the fit hole for said recording head may be provided on the taper plane of said tapered fit pin.

Also, there may be provided on said holding means guide means for mounting said recording means to said holding means and restraining means for restraining the positional deviation from said mounting position.

Also, the width of said contact means may be smaller in the direction of signal line toward the top end.

Also, said contact means may be a flexible substrate, with a engagement portion provided at the top end of said flexible substrate and a slit for inserting and engaging said engagement portion at the top end provided on said coupler means or said contat means.

In this case, the top end of said flexible substrate may be movable in an insertion direction of said slit.

Also, a guide portion and a restraining portion corresponding to said guide means and restraining means of said coupler means may be provided on said recording means.

In this case, said guide means opposed to said recording means has a recording medium conveying guide plane making contact with said recording medium, and may be formed with at least one recess portion in an area on said recording medium conveying guide plane opposed to a replacement position along said main scan direction.

In this case, said replacement position may be within a printing area of the recording medium.

Further, said recording means is opposed to said recording medium conveying guide plane of said guide means and has a top end face formed with a step, the height of said step being greater than the depth of said recess portion formed on said recording medium conveying guide plane.

Also, the width of said recess portion on said recording medium guide plane may be greater than the width of said top end face of said recording means plus the amount of moving said recording means in a predetermined direction required to detach said recording means from said carriage.

Also, said recess portion is formed concavely by at least two ribs among the ribs protruded along said conveying direction on said recording medium conveying guide plane and arranged at a predetermined interval, and a region on said recording medium conveying guide plane between said at least two ribs.

In this case, said recess portion may be formed concavely by forming a through hole on said recording medium conveying guide plane and disposing suction means for sucking the ink through said through hole, with said suction means as the bottom portion.

In any one of the recording apparatuses as above described, said recording means may be a head cartridge having integrally an ink jet recording head utilizing electricity-heat converters for causing film boiling in the ink as means for generating energy to discharge the ink, and an ink tank for supplying the ink to said ink jet recording head.

The ink tank of the present invention may be an ink tank for use in the head cartridge as above described, wherein said ink tank comprises a guide member for guiding said head cartridge detachably held in a head holder of said recording apparatus on at least one side face of said ink tank, and a positioning member for detachably disposing said head holder at a fixed position within said head holder.

A recording apparatus of the present invention utilizing the ink tank above constituted is characterized in that the face plane of said recording head has a member for engaging with the positioning member provided on said head holder.

In the recording apparatus with various constructions as above described, the movement direction of coupler means may be a carriage moving direction.

Also, the holding member may be formed with a taper on the arm provided, and a recess at a site corresponding to a portion of said recording means for discharging the ink.

Also, in the state in which electrical contact means and recording means are connected, the arm provided in the holding member is located between the electrical contact surface and the carriage.

Also, capping means for capping recording means is provided at a predetermined capping position, in which said capping position and the replacement position may be different.

Also, said recording head may be a recording head of the ink jet system having discharge ports for discharging the ink and energy generating elements for generating the energy to discharge the ink through said discharge ports, which performs the recording by discharting the ink through said discharge ports by driving said energy generating elements based on the recording signal.

An information processing equipment of the present invention is characterized by comprising a recording apparatus described above as output means.

The recording apparatus of the present invention as above constituted has restraining means for fitting a second fitting means for restraining the position of the recording head in the second direction prior to a first fitting means for restraining the position of the recording head in the first direction, so that the second fitting means is fitted ahead in positioning the recording head in holding means. Therefore, the sliding resistance or the loss of force may be reduced, so that the recording head can be securely positioned at a predetermined site. If each of the fitting means is comprised of a fit pin and a fit hole, its construction is simple, and by using the fit pin of tapered shape, the fitting of the fit pin is more easily accomplished.

Also, the positioning means is provided at least on a predetermined plane having electrical contact means in contact with the electrical contact surface of recording means mounted on the carriage, and further electrical contact means is projected from the predetermined plane along the direction of coupling or decoupling said recording means. Also, preferably, guide means opposed to recording means has a recording medium conveying guide plane in contact with the recording medium, and is formed with at least one recess portion in an area on the recording medium conveying guide plane opposed to the replacement position along the main scan direction. Accordingly, the electrical contact between the recording head and the carriage can be securely made, and the carriage can be detached without the face plane of the recording head rubbing against the guide plane of recording sheet conveying means, whereby the image formation can be achieved without degrading the recording quality.

BRIEF DESCRIPTION OF THE DRAWINGS

FIGS. 4A to 4D are views for explaining the appearance of a head cartridge (hereinafter simply referred to as a head) mounted on the recording apparatus according to the present invention, wherein FIG. 4A is a rear view, FIG. 4B is a front (or face plane) view as looked from the arrow 4B of FIGS. 4A, 4C and 4D are side views as looked from the arrow 4C and the arrow 4D of FIG. 4A.

FIGS. 5A and 5B are front views of a carriage portion of the recording apparatus according to the present invention, wherein FIG. 5A shows the state before the head 7 is completely mounted, and FIG. 5B shows the state in which it is completely mounted.

FIGS. 8A and 8B are views for explaining the construction of a main portion of a head coupling mechanism of the recording apparatus according to the present invention, wherein FIG. 8A is a typical view as looked from the above, and FIG. 8B is a typical view as looked from the front side.

FIGS. 9A and 9B are views for explaining the constitution of a head fit pin of the recording apparatus according to the present invention, wherein FIGS. 9A and 9B show the fit pin provided at different positions, respectively.

FIGS. 10A to 10C are views for explaining the state of incorporating a top end portion of a flexible substrate for the recording apparatus according to the present invention, wherein FIG. 10A shows the state in which the top end portion 562 is incorporated, and FIGS. 10B and 10C show the process of inserting the top end portion.

FIGS. 19A and 19B are enlarged views of a fit pin in the carriage portion according to the seventh embodiment of the present invention, wherein FIG. 19A is a side view of a round fit pin and FIG. 19B is a front view of a square fit pin.

DETAILED DESCRIPTION OF THE PREFERRED EMBODIMENT

The preferred embodiments of the present invention will be now described in detail with reference to the drawings.

[Embodiment 1]

Figure 1:
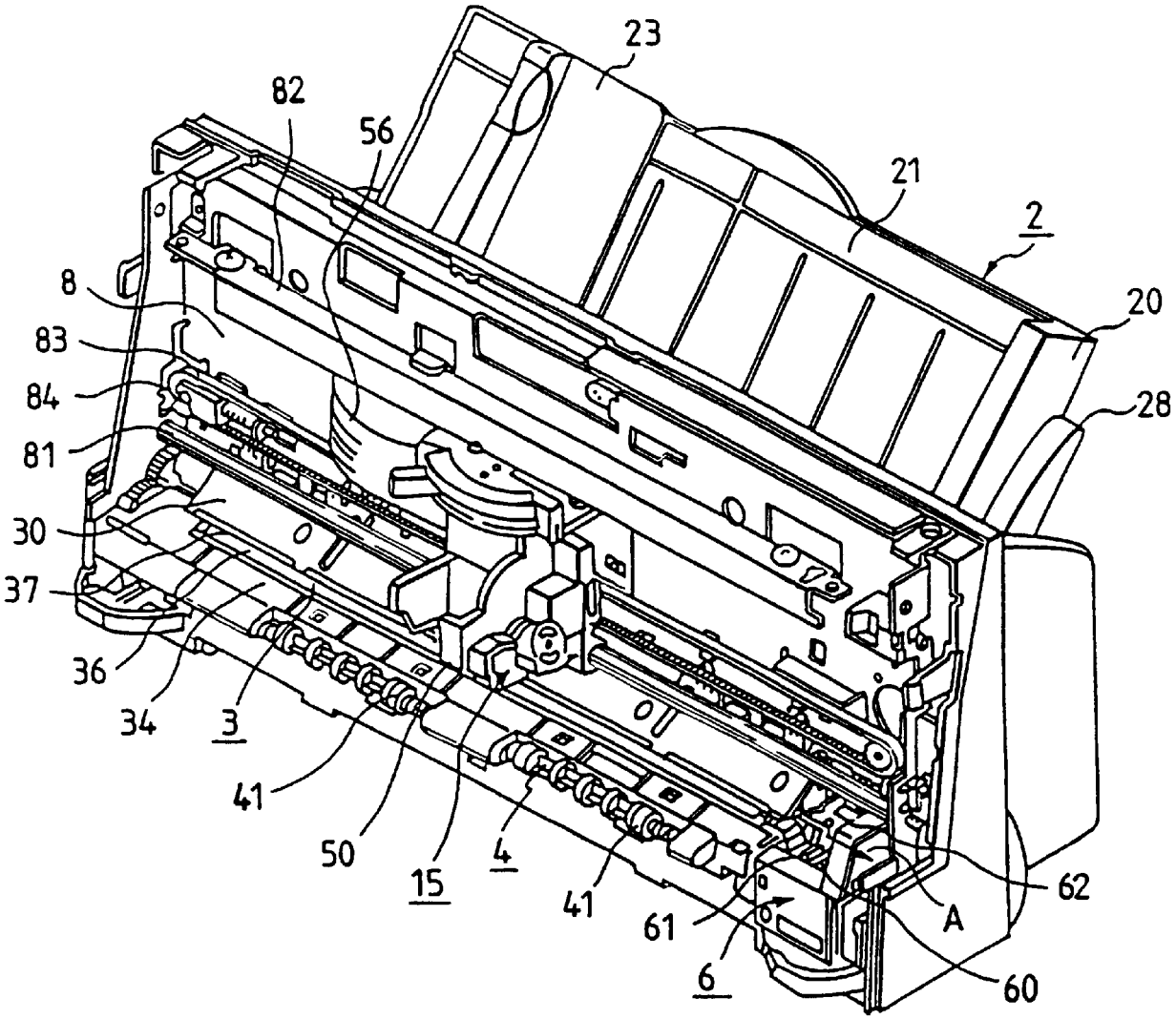
FIG. 1 is a perspective view showing the overall constitution of a recording apparatus according to the present invention.
Figure 2:
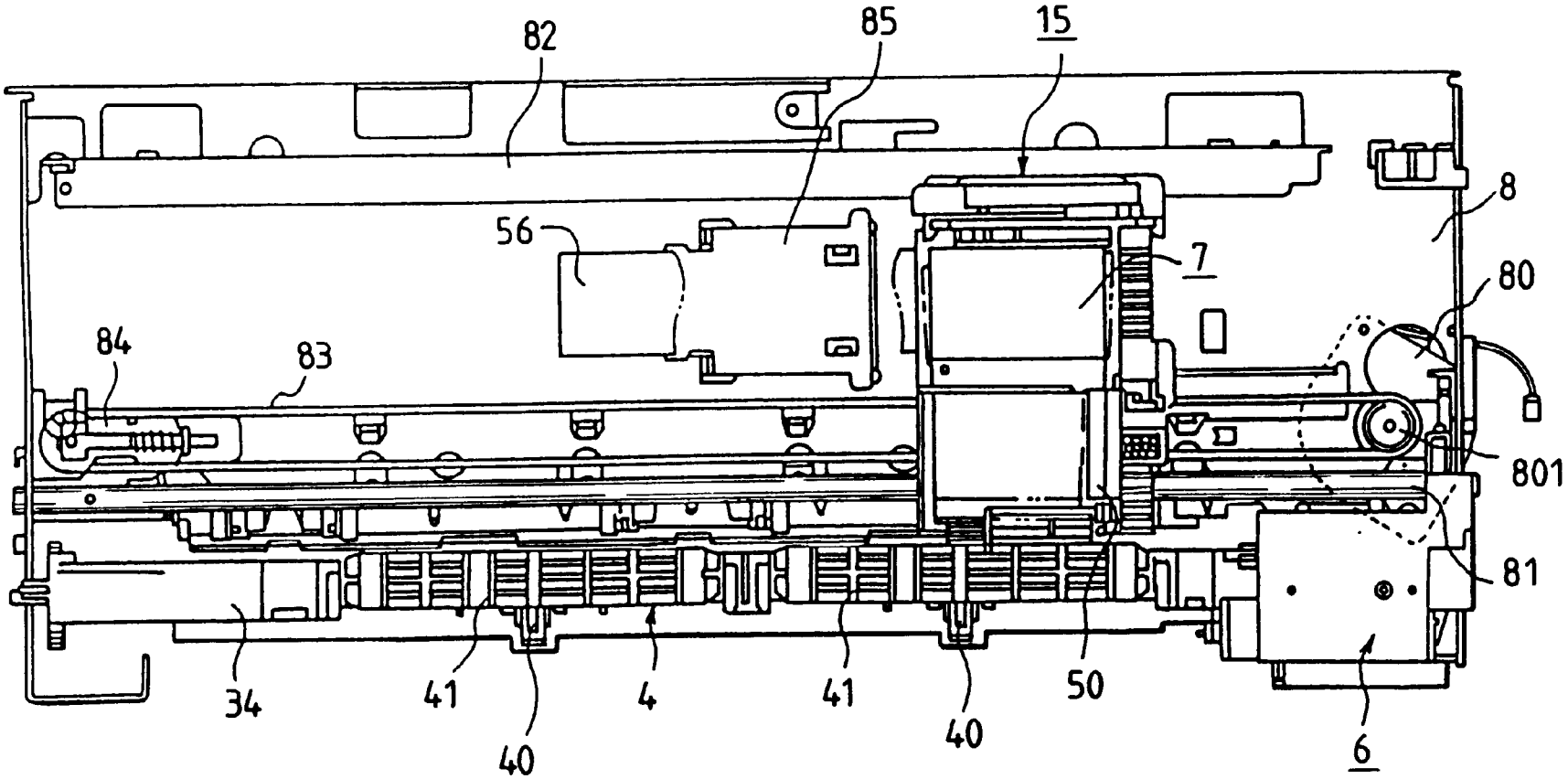
FIG. 2 is a front view of the recording apparatus according to the present invention.
Figure 3:
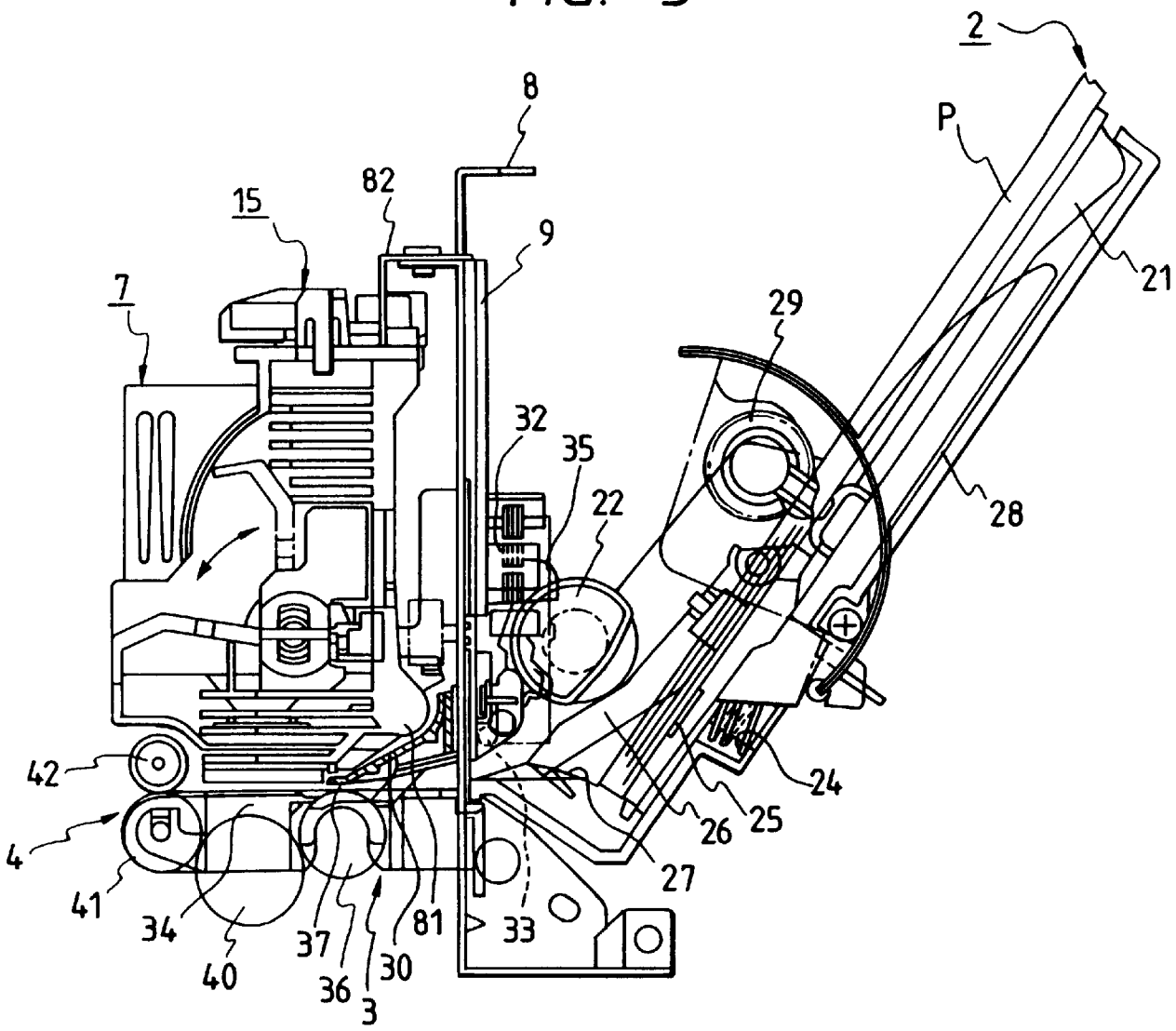
FIG. 3 is a side cross-sectional view of the recording apparatus according to the present invention.

The schematic constitution of a recording apparatus according to the present invention will be described below with reference to FIGS. 1 to 3. FIG. 1 is a perspective view showing the overall constitution of the recording apparatus 1, FIG. 2 is a front view of the recording apparatus 1, and FIG. 3 is a side cross-sectional view of the recording apparatus 1.

The recording apparatus 1 having an automatic sheet feeder is comprised of a sheet supply portion 2, a sheet feeder portion 3, a sheet exhausting portion 4, a carriage portion 15, and a cleaning portion 6. Each portion will be schematically described in order.

(A) Sheet supply portion

A sheet supply portion 2 has a pressure plate 21 for loading the recording sheets P thereon and a feed roller 22 for feeding the recording sheet P which are attached to a base 20. The pressure plate 21 is movably provided with a movable side guide 23 to restrain the loading position of the recording sheet P. The pressure plate 21 is rotatable around a shaft coupled to the base 20, and biased against the feed roller 22 by a pressure plate spring 24. On a region of the pressure plate 21 opposed to the feed roller 22, a separation pad 25 made of a material having great friction coefficient such as an artificial leather is provided to prevent the recording sheet P from being conveyed by its own weight. Further, on the base 20, there are provided a separation claw 26 for separating the recording sheets P one by one by covering the corner portion of the recording sheets P in one direction, a bank portion 27 integrally molded on the base 20 to separate the card boards for which the separation claw 26 is unusable, a switch lever 28 for switching the separation claw 26 to be active at the normal paper position or inactive at the card board position, and a release cam 29 for releasing the contact between the pressure plate 21 and the feed roller 22.

In the above constitution, the release cam 29 presses the pressure plate 21 down to a predetermined position on standby. Thereby, the contact between the pressure plate 21 and the feed roller 22 is released. In this state, if a driving force of a conveying roller 36 is transmitted via gears to the feed roller 22 and the release cam 29, the release cam 29 is left away from the pressure plate 21, so that the pressure plate 21 moves upward, and the feed roller 22 comes into contact with the recording sheet P to pick up the recording sheet P along with the rotation of the feed roller 22, thereby starting to feed the sheet which is separated one by one by means of the separation claw 26 and then fed to the sheet feeder portion 3. The feed roller 22 and the release cam 29 are rotated until the recording sheet P is fed into the sheet feeder portion 3, and the driving force from the conveying roller 36 is cut off on standby in which the contact between the recording sheet P and the feed roller 22 is released.

(B) Sheet feeder portion

The sheet feeder portion 3 has a conveying roller 36 for conveying the recording sheet P and a PE sensor 32. The conveying roller 36 has a driven pinch roller 37 contacted therewith. The pinch roller 37 is held on a pinch roller guide 30, and biased by a pinch roller spring 31 to press the pinch roller 37 against the conveying roller 36 to produce the conveying force of the recording sheet P. Further, at the entry of the sheet feeder portion 3 for the recording sheet P to be conveyed, an upper guide 33 for guiding the recording sheet P and a platen 34 are disposed. Also, the upper guide 33 is provided with a PE sensor lever 35 for transmitting the detection of the leading end and the trailing end of the recording sheet P to the PE sensor 32. Further, a head cartridge 7 to form image based on image information is provided downstream of the conveying roller 36 in a recording sheet conveying direction.

In the above constitution, the recording sheet P fed to the sheet feeder portion 3 is fed to a pair of rollers consisting of the conveying roller 36 and the pinch roller 37, while being guided by the platen 34, the pinch roller 30 and the upper guide 33. At this time, the printing position of the recording sheet P is obtained by detecting the leading end of the recording sheet P conveyed to the PE sensor lever 35. Also, the recording sheet P is conveyed on the platen 34 by the pair of rollers 36, 37 being rotated by an LF motor, not shown.

Note that the head cartridge 7 used herein is an ink jet recording head constituted integrally with an ink tank which is easy to replace. This head cartridge 7 can apply the heat by heater to the ink. And the ink can bring about film boiling due to this heat, and is discharged through the nozzles 70 of the recording head cartridge 7 owing to the variation in pressure caused by growth and shrinkage of bubbles produced by the film boiling to effect image formation on the recording sheet P.

(C) Carriage portion

The carriage portion 5 has a carriage 50 on to which the head cartridge 7 is mounted.

And the carriage 50 is supported by a guide shaft 81 for serving to scan reciprocatively in a direction (main scan direction) orthogonal to a conveying direction of the recording sheet P (sub-scan direction), and a guide rail 82 for maintaining the clearance between the head cartridge 7 and the recording sheet P by holding the trailing end of the carriage 50. Note that the guide shaft 81 and the guide rail 82 are attached to a chassis 8. Also, the carriage 50 is driven via a timing belt 83 by a carriage motor 80 attached to the chassis 8. This timing belt 83 is extended and supported by an idle pulley 84. Further, the carriage 50 has a flexible substrate 51 for passing a signal from an electrical substrate 9 to the head cartridge 7.

In the above construction, when the image is formed on the recording sheet P, the recording sheet P is conveyed to a row position for forming the image (in the conveying direction of the recording sheet P) by the pair of rollers 36, 37, and the carriage 50 is moved to a position for forming the image (a position perpendicular to the conveying direction of the recording sheet P) by the carriage motor 80, so that the head cartridge 7 is placed opposite the image forming position.

(D) Sheet exhausting portion

The sheet exhausting portion 4 is provided, with a transmission roller 40 being in contact with the conveying roller 36 and a sheet exhausting roller 41. Accordingly, the driving force of the conveying roller 36 is transmitted via the transmission roller 40 to the sheet exhausting roller 41. Also, a spur 42 is contacted with the sheet exhausting roller 41 to be rotatable by being driven by the sheet exhausting roller 41. In the above constitution, the recording sheet P having the image formed in the carriage portion 5 is carried in the nip between the sheet exhausting roller 41 and the spur 42 to the conveyed and exhausted into a sheet exhausting tray, not shown.

(E) Cleaning portion

The cleaning portion 6 is comprised of a pump 60 for cleaning the head cartridge 7, a cap 61 for preventing the recording head 7 from drying, and a driving switch arm 62 for switching the driving force from the conveying roller 36 to either the sheet supply portion 2 or the pump 60. When the driving switch arm 62 is other than the sheet supply and the cleaning, no driving force is transmitted to the sheet supply portion 2 and the pump 60, because a planetary gear (not shown) rotating around the shaft center of the conveying roller 36 is secured to a predetermined position. If the driving switch arm 62 is moved in a direction of the arrow A by movement of the carriage 50, the planetary gear becomes free and is moved in accordance with the forward or backward rotation of the conveying roller 36, in which if the conveying roller 36 is rotated in the forward direction, the driving force is transmitted to the sheet supply portion 2, and if in the backward direction, the driving force is transmitted to the pump 60.

Referring now to FIGS. 4A to 10C, each of the main components of the platen 34 corresponding to the recording sheet guide plane for the guide means for the carriage portion 15 and the sheet feeder portion 3 will be described in detail.

Figure 4A:
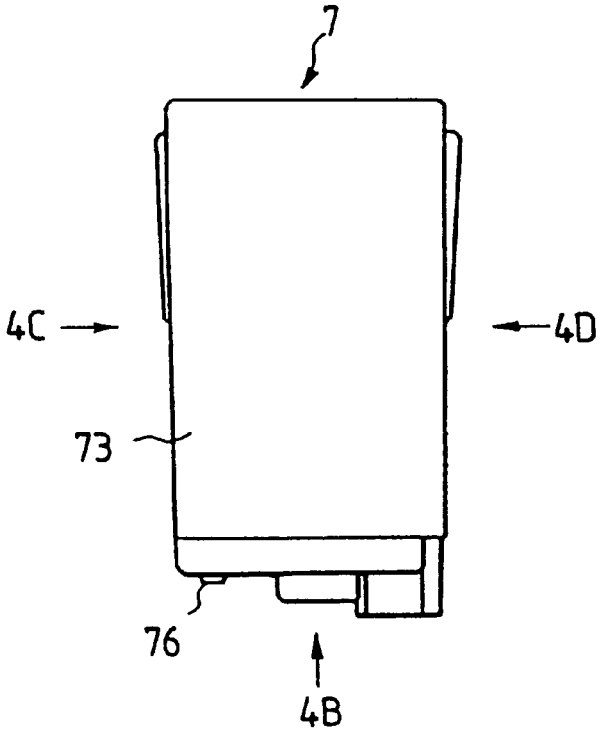
Figure 4B:
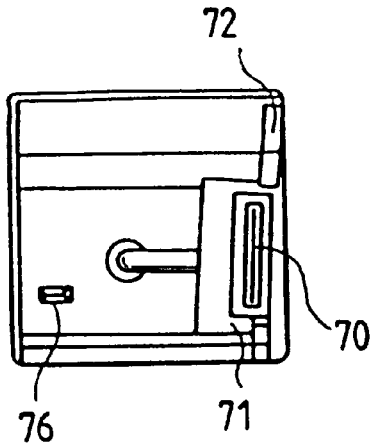
Figure 4C:
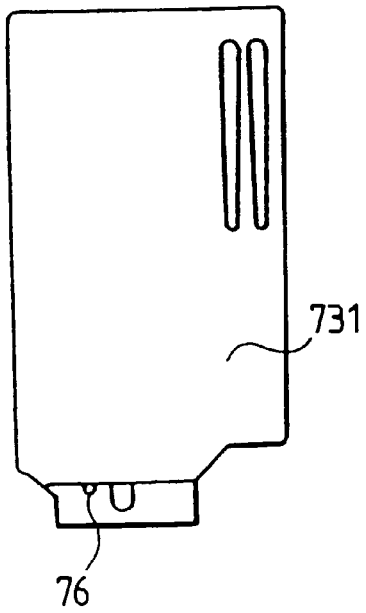
Figure 4D:
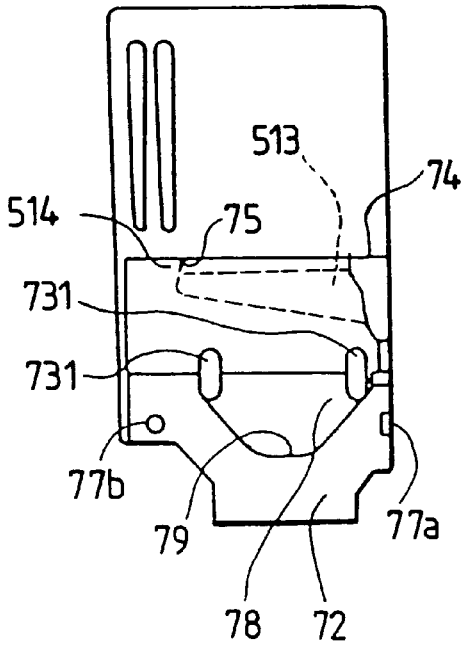
Figure 5B:
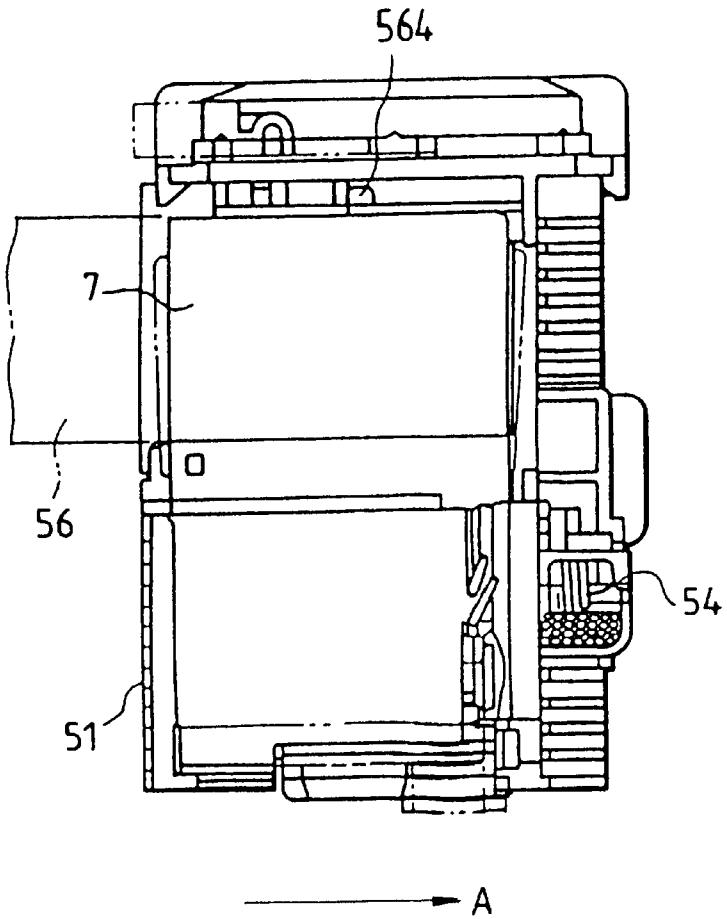
Figure 5A:
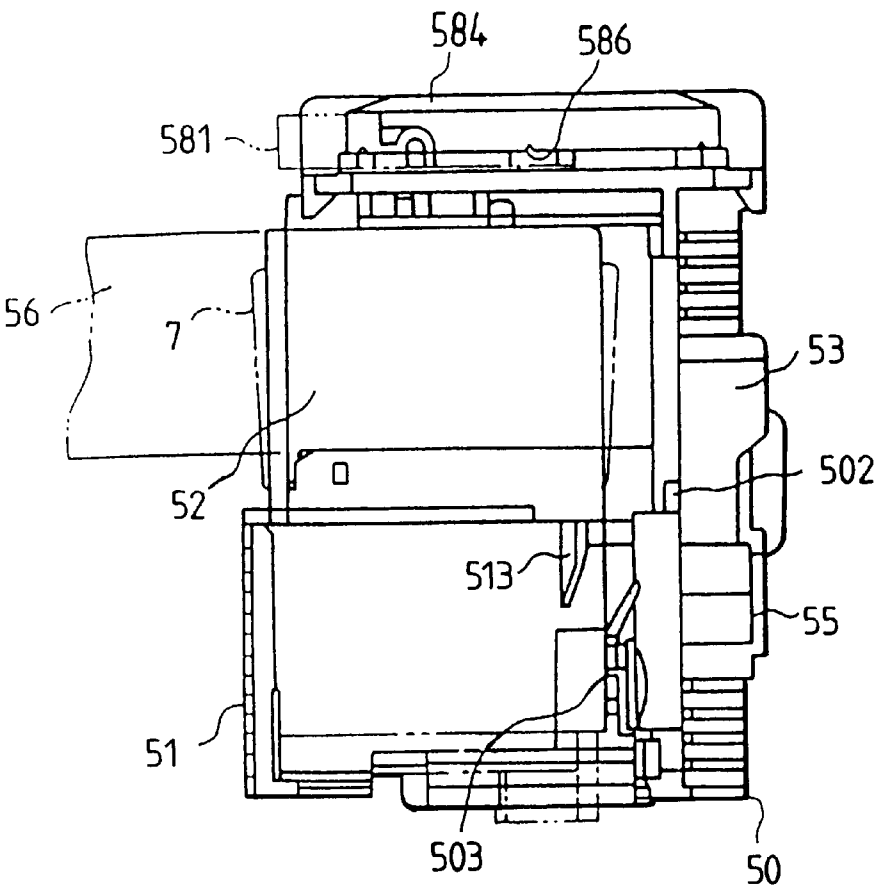
Figure 6:
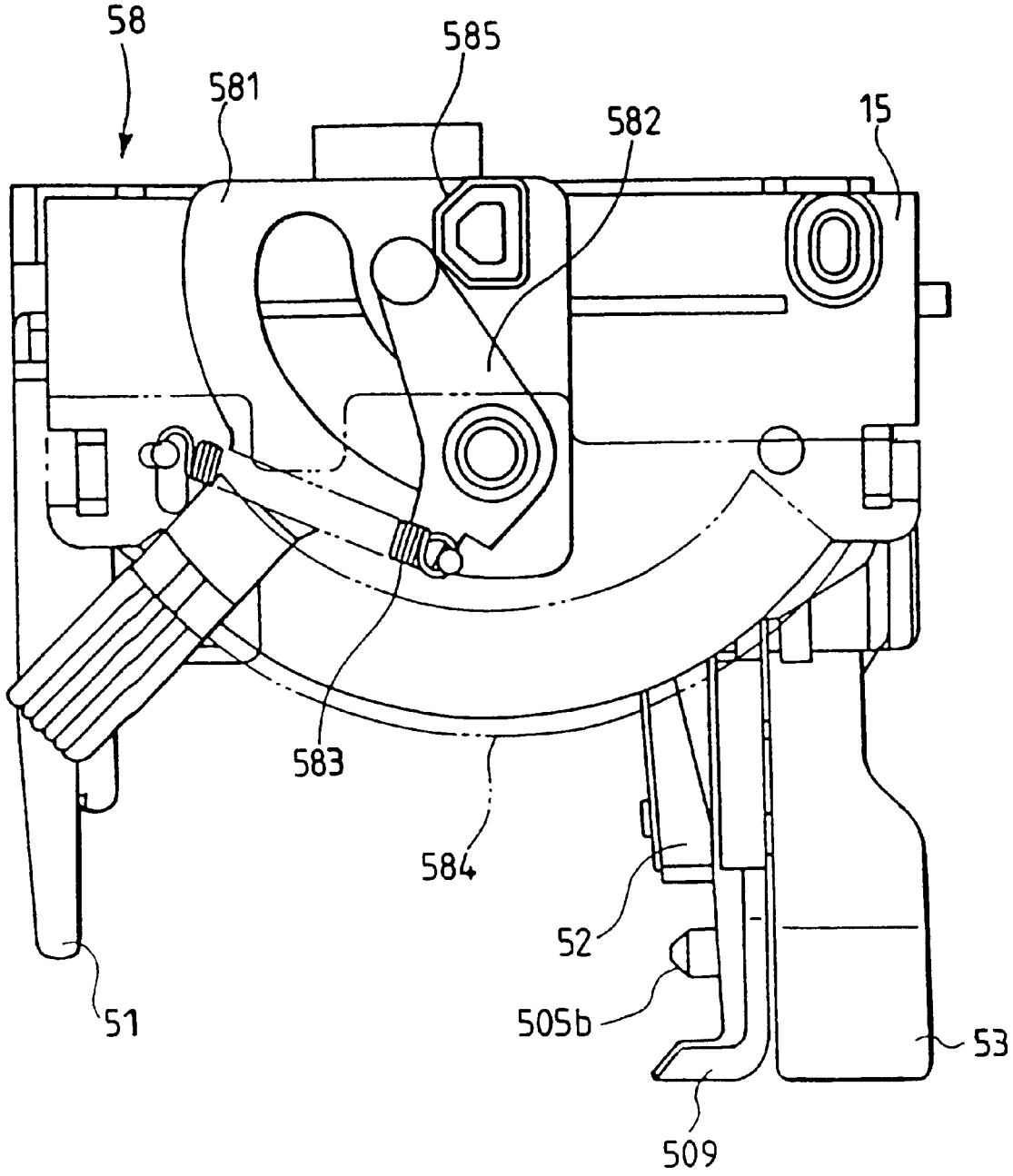
FIG. 6 is a plan view of the carriage portion of the recording a apparatus according to the present invention.
Figure 7:
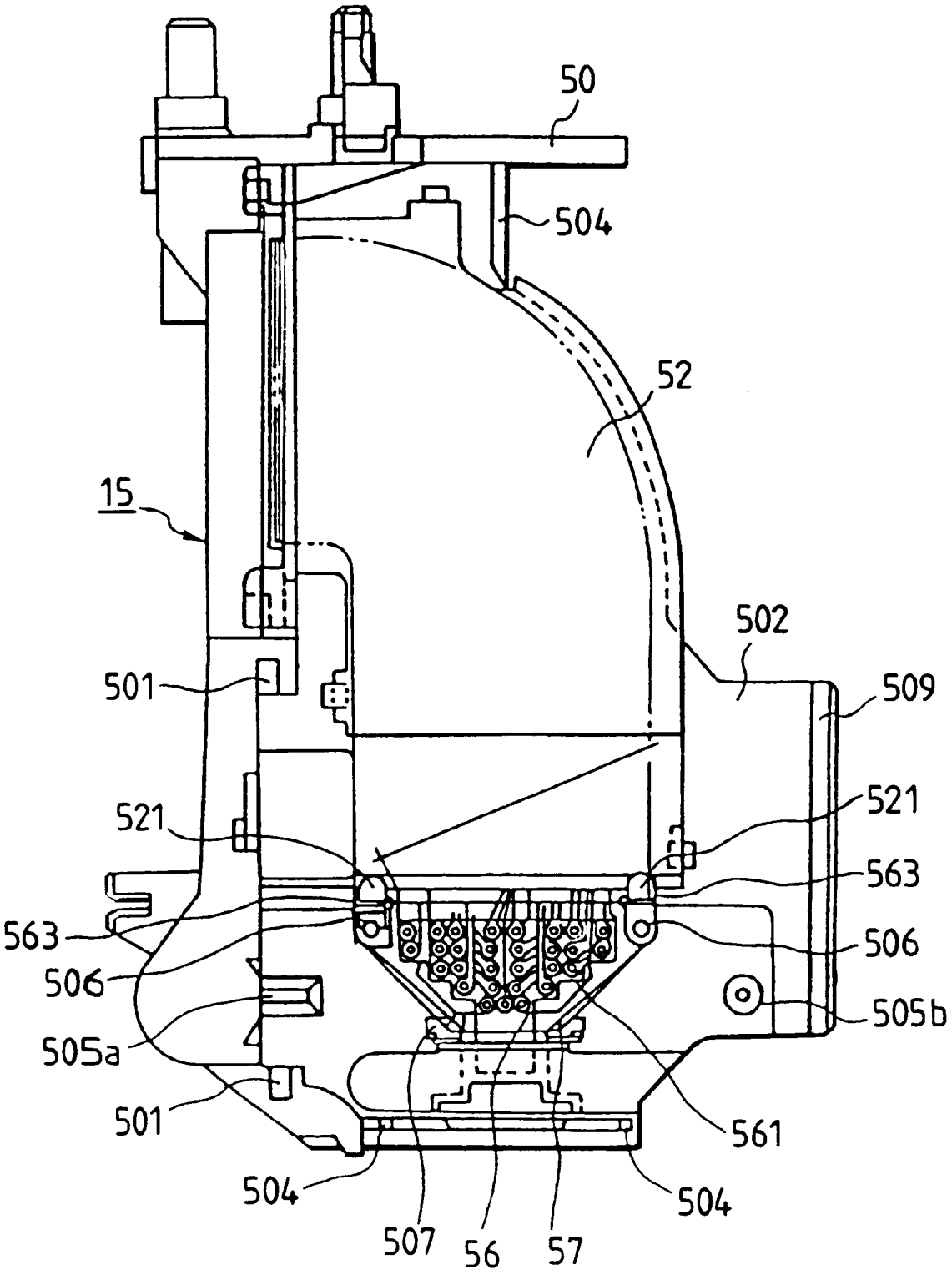
FIG. 7 is a view for explaining the construction of a contact portion in the carriage portion of the recording apparatus according to the present invention.
Figure 8A:
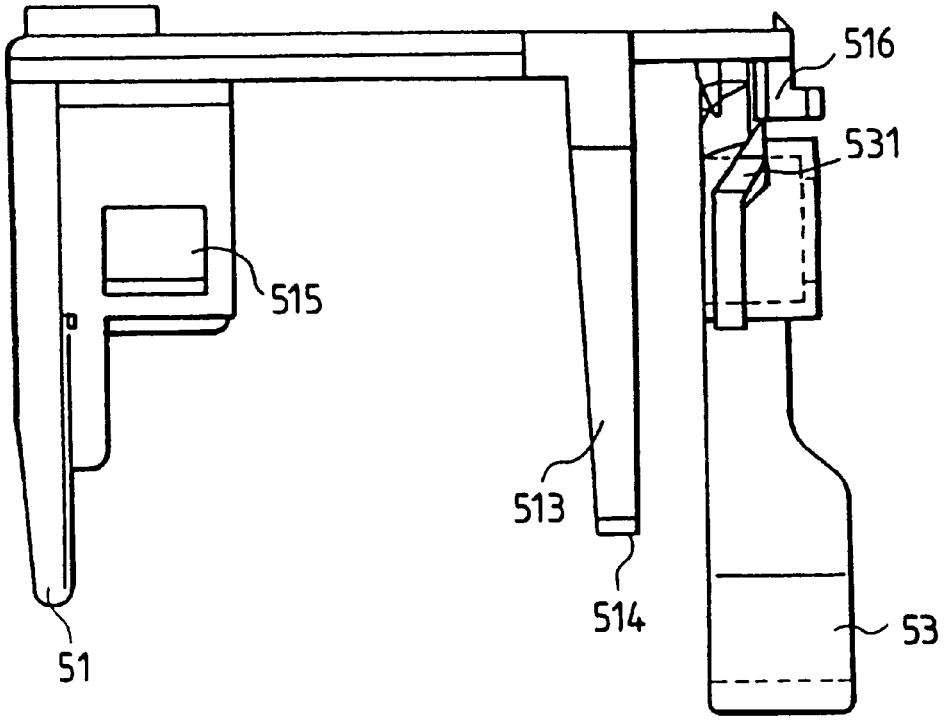
Figure 8B:
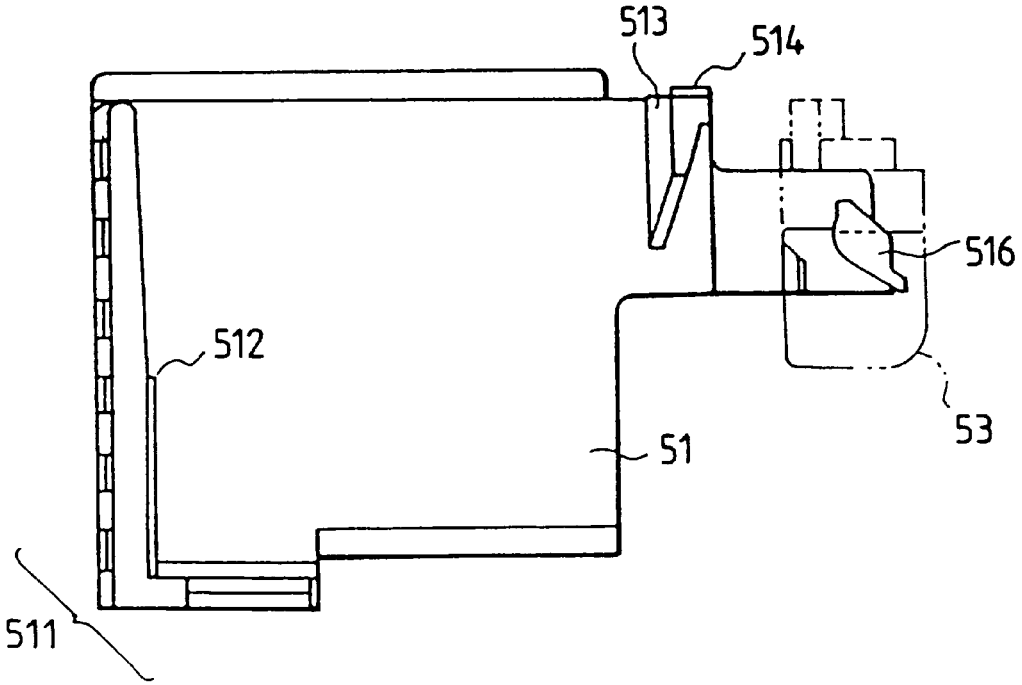
Figure 9A:
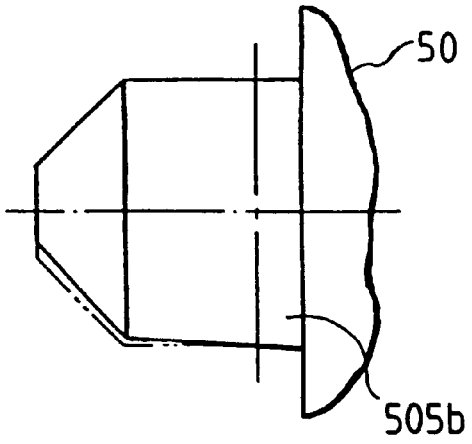
Figure 9B:
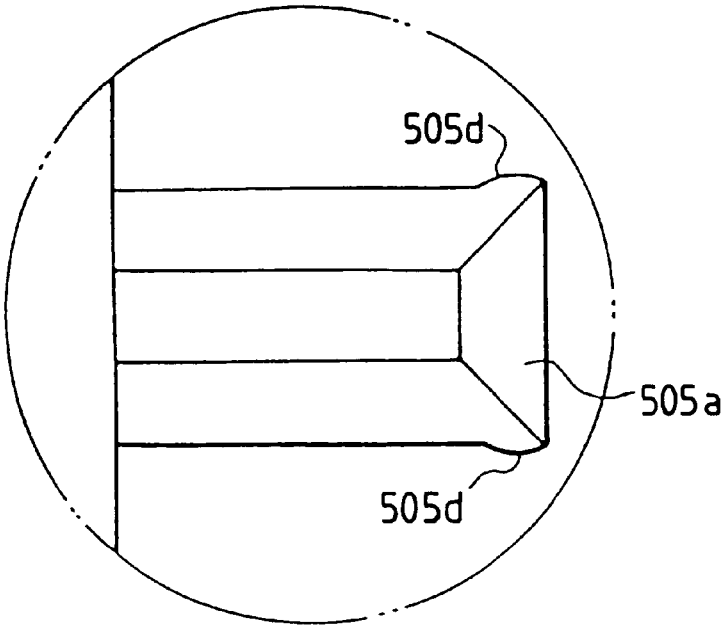
Figure 10A:
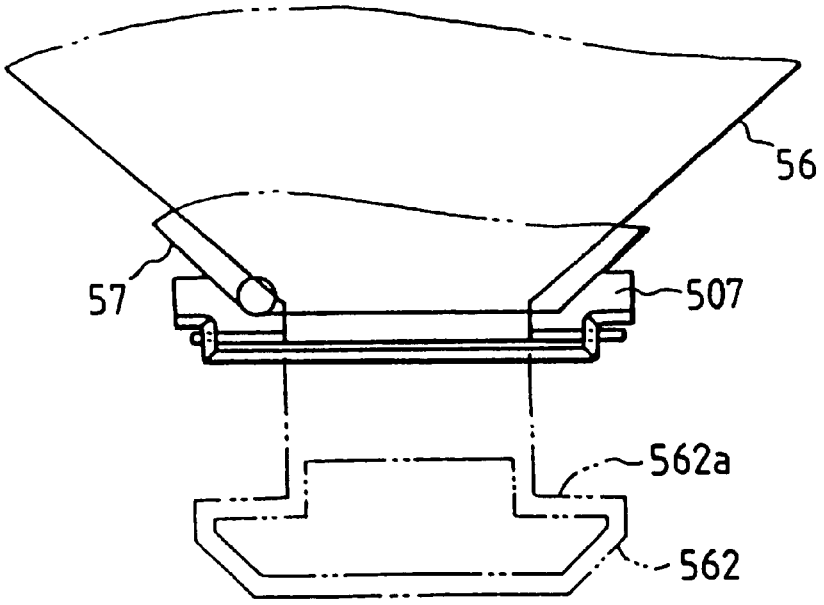
Figure 10B:
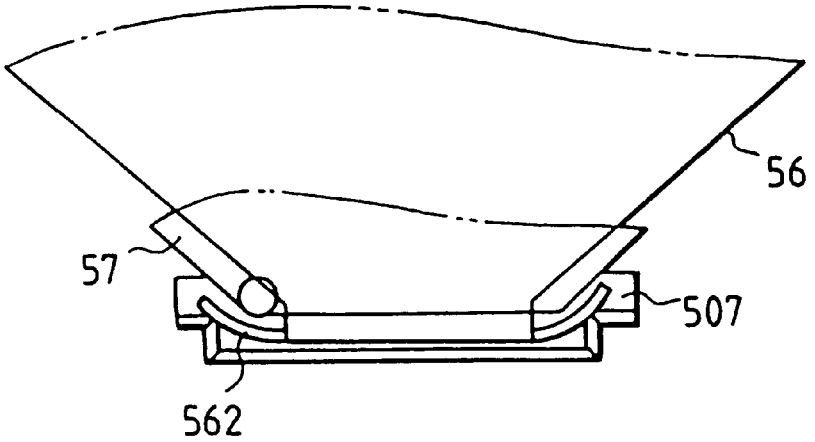
Figure 10C:
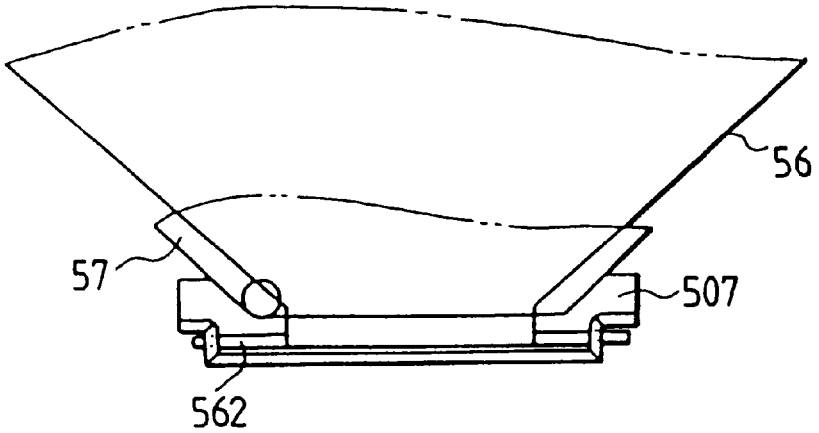
Figure 11:
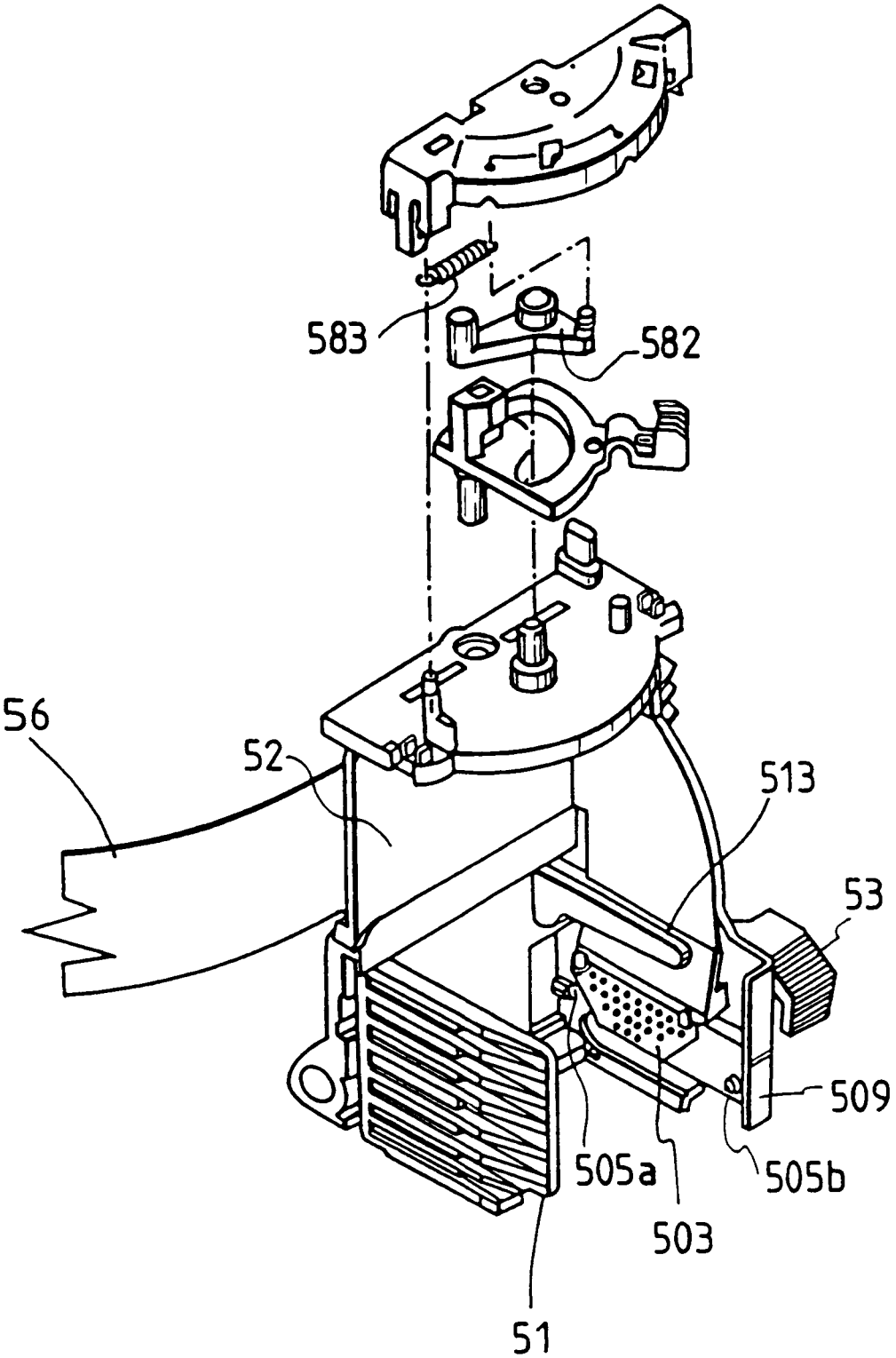
FIG. 11 is an exploded perspective view showing in detail the constitution of a carriage portion 15.
Figure 12:
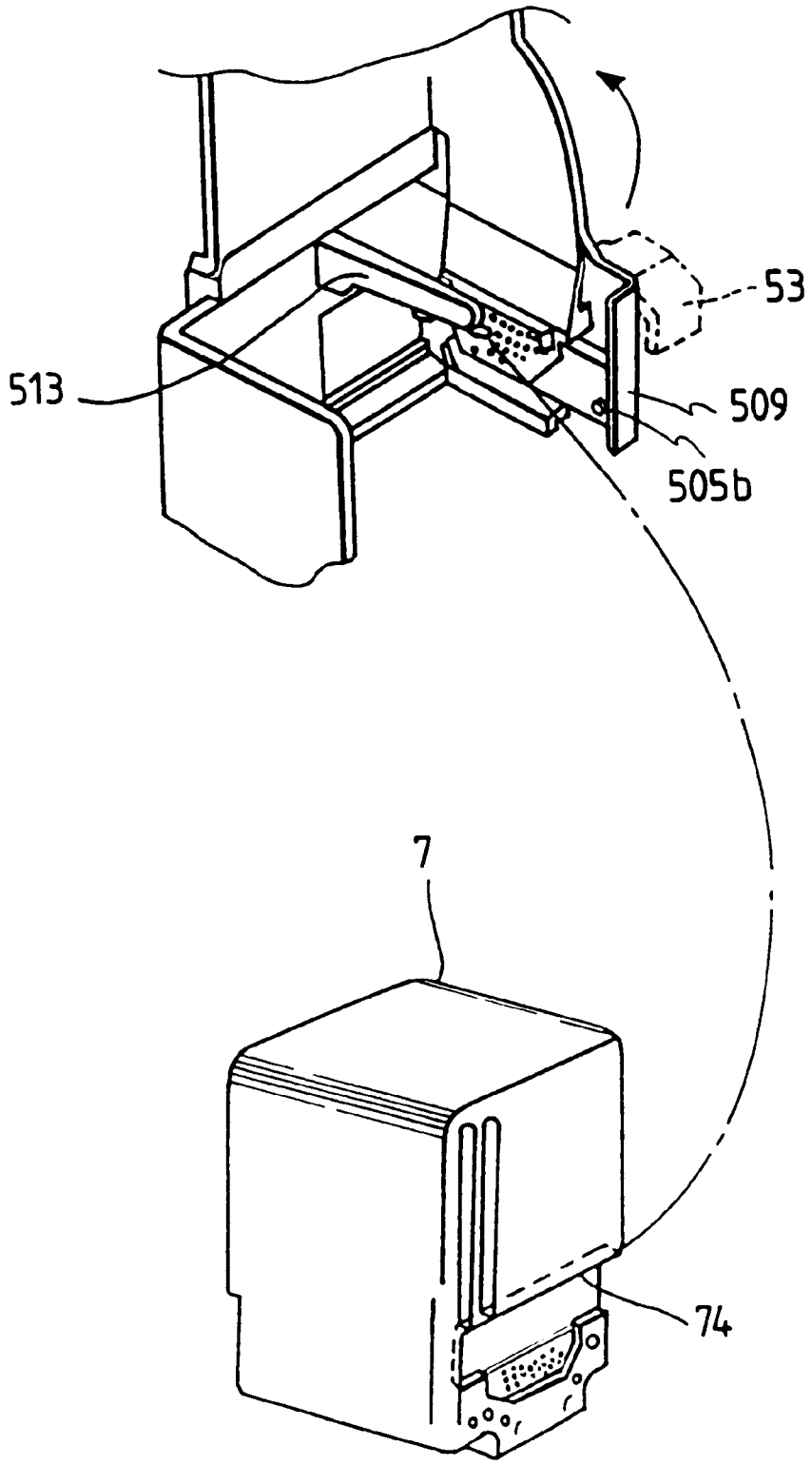
FIG. 12 is a perspective view showing how to mount a head cartridge 7 onto the carriage portion 15.

FIGS. 4A to 4D are views for explaining the appearance of a head cartridge 7 (hereinafter simply referred to as a head) to be mounted on the recording apparatus (see FIGS. 1 to 3) according to the present invention, wherein FIG. 4A is a rear view, FIG. 4B is a front view as looked from the arrow 4B of FIGS. 4A, 4C and 4D are side views as looked from the arrow 4C and the arrow 4D of FIG. 4A, respectively. FIGS. 5A and 5B are front views of the carriage portion 15, wherein FIG. 5A shows the state before the head cartridge 7 is completely mounted, and FIG. 5B shows the state in which it is completely mounted. FIG. 6 is a plan view of the carriage portion 15. FIG. 7 is a view for explaining the construction of the contact portion 503 of the carriage portion 15. FIGS. 8A and 8B are views for explaining the construction of the main component of the coupling mechanism of the head cartridge 7, wherein FIG. 8A is a plan view, and FIG. 8B is a front view. FIGS. 9A and 9B are views for explaining the construction of a fit pin 505 of the head cartridge 7 of the carriage 50, wherein FIGS. 9A and 9B show the fit pin provided at different sites, respectively. And FIGS. 10A to 10C are views for explaining the state of incorporating a top end portion 562 of the flexible substrate 56, wherein FIG. 10A shows the state in which the top end portion 562 is incorporated, and FIGS. 10B and 10C shows the process of inserting the top end portion. FIG. 11 is an exploded perspective view showing the details of the construction of the carriage portion 15, and FIG. 12 is a perspective view showing the state of mounting the head cartridge 7 onto the carriage portion 15.

The constitution of the head cartridge 7 mounted on the recording apparatus according to the present invention is basically the same as that of the conventional head cartridge as already described and shown in FIG. 22, but is different in the following points.

The head cartridge 7 of this embodiment is provided with a guide 74 on the side face of an ink tank 73, and can be mounted in a head holder along the upper surface of a guide arm 513 of the head holder as will be described later by virtue of this guide 74. And at a predetermined position where the head cartridge 7 is mounted, if a concave portion 75 formed in the guide 74 of the head cartridge 7 is fitted with a convex portion 514 provided at a site on the head holder 51 corresponding to said concave portion 75, the head cartridge 7 is secured detachably at a fixed position within the head holder 51.

Further, the face plane of the head cartridge 7 is provided with a convex portion 76, while a corresponding receptacle of the head holder 51 is provided with a concave portion 515 corresponding to the convex portion 76. Thereby, in mounting the head cartridge 7, the nozzle face 70 will not contact with the platen 34 to give damage to the head cartridge 7. And since a so-called click feeling can be obtained upon mounting by the fitting between these concave and convex portions, the operator can confirm easily whether the head cartridge 7 is correctly mounted in the head holder. Also, by engagement of the convex portion 514 of the head cartridge 51, the unstable conditions which may occur in coupling the head cartridge 7, such as the falling of the head cartridge 7 on the front face or the misregistration after mounting, can be eliminated.

In this embodiment, the constitution of the carriage portion 15 to mount the head cartridge is as follows.

The carriage portion 15 consists of a unit having components attached to a carriage 50.

A coupler portion for coupling the head cartridge 7 on the recording apparatus is comprised of a carriage 50, a head holder 51, a base cover 52, a hook lever 53, a contact spring 54, a hook cover 55, a flexible substrate 56, and a rubber pad 57.

As shown in FIGS. 5A and 5B, the head holder 51 is provided on the carriage 50, and can mount the head cartridge 7 along a guide 501 (see FIG. 7) comprised of a groove extending in the main scan direction to be slidable to the left and right (in the main scan direction) in the figure. The head holder 51 is provided with a guide portion 511 for guiding the head cartridge 7, and a pressure portion 512 (see FIGS. 8A and 8B) for pressing the head cartridge 7 against a contact surface 503 and a positioning plane 504 on a lateral plate 502 stood up vertically on the carriage 50. In this embodiment, the positioning plane of the lateral plate 502 for the carriage is provided at three points. That is, two points corresponding to and over the base plate 72 in the neighborhood of the nozzle 70 of the head. cartridge 7, and one point corresponding to and upward of the ink tank 73 for the head cartridge 7.

The contact surface 503 between the head cartridge 7 and the carriage 50 is configured to be located within a triangle formed of three points of this positioning plane 504. The pressing position of the pressure portion 512 of the head holder 51 is within the triangle formed by connecting these three points. Also, a guide arm 513 is provided at an opposite position of the pressure portion 512 of the head holder 51, and this guide arm 513 makes contact with the head cartridge 7 in separating the head cartridge 7 away from the contact surface 503. On the lateral plate 502 of the carriage 50 is provided a rib 509 which is also used as the guide in coupling or decoupling the head cartridge, serving to protect or hide the contact surface 561 of the flexible substrate 56 as will be described later.

The hook lever 53 is attached rotatably on the lateral plate 502 of the carriage 50. A contact spring 54 is provided at the center of rotation of the hook lever 53 to bias the hook lever 53 in a slide direction of the head holder 51 (direction of the arrow A in FIG. 5B). The hook cover 55 is attached to cover the hook lever 53 to hold the hook lever 53 not to get rid of the carriage 50. As shown in FIGS. 8A and 8B, the hook lever 53 and the head holder 51 have cams 516, 531 contacted with each other, respectively, the head holder 51 being movable in the main scan direction by the rotation of the hook lever 53. Also, the biasing force of the contact spring 54 serves as the pressing force against the head cartridge 7 of the head holder 51 via the hook lever 53.

On the lateral plate 502 of the carriage, fit pins (505*a*, 505*b*) for positioning of the head cartridge 7 are provided. As shown in FIG. 7 and FIGS. 9A and 9B, two fit pins are provided corresponding to fit holes 77 of the base plate 72 of the head cartridge 7. The base plate 72 of the head cartridge 7 is inclined at about 1° to 4° to the main scan direction of the carriage portion 15. To cope with the inclined fit holes 77, one of the fit holes 77 of the base plate 72 for the head cartridge 7 is a square hole 77*a*, and the other is a round hole 77*b*. Also, a fit pin 505*a* on the carriage 50 corresponding to the square hole 77*a* is a square pin having a cylindrical shape partly, and a fit pin 505*b* on the carriage corresponding to the round hole 77*b* is configured as follows. That is, an undercut portion on the mold configuration for the carriage is removed to arrow for the fitting at a site at which the head cartridge 7 is abutted against the positioning plane 504 of the carriage. In this way, the correct and smooth positioning of the head cartridge 7 with respect to the inclined base plate 72 is permitted without need of complex mold structure.

As shown in FIG. 7, the contact surface 503 (see FIG. 5A) provided on the lateral plate 502 of the carriage 50 has a rubber pad 57 composed of an elastic material such as silicone rubber having a rubber hardness of 30° to 50° (JIS standard) to enable electrical contact with the head cartridge 7. And a contact portion 561 of the flexible substrate 56 is provided thereon. The rubber pad 57 and the flexible substrate 56 are both positioned by a positioning pin 506 provided on the lateral plate 502 of the carriage 50. On the opposite side of the contact portion 561 of the positioning portion on the flexible substrate 56 is provided a slit 563 to prevent the effect such as deformation of the flexible substrate 56 on assembling from being exerted on the contact portion 561. A top end 562 of the contact portion 561 on the flexible substrate 56 is slender in conformity with the shape of the base plate 72, and provided with an engagement portion 562 at the end portion.

Thus, with the contact portion 561 being made like a triangular shape and with smaller number of contact pads provided closer to the top end, the forming of the signal line is facilitated to have the higher density. Also, the processing for the top end portion 562 of the flexible substrate 56 is facilitated.

On the lateral plate 502 of the carriage 50, a slit 507 is provided to insert the top end portion 562 of the flexible substrate 56. As shown in FIG. 10B, this top end portion 562 is warped and inserted into the slit 507. Upon passing through the slit 507, the top end portion is straightened and engaged so that it may not fall out as shown in FIG. 10C. With this construction, the top end portion is free, and the contact surface 561 of the flexible substrate 56 does not have rigidity to establish good contact with the contact surface of the head cartridge 7. If the head cartridge 7 is mounted, the contact portion 503 of the carriage 50 comes into a notch portion 79 of the base plate 72 of the head cartridge 7, and makes contact with the contact surface 78 formed inside the notch portion 79.

As shown in FIGS. 5A and 5B, the flexible substrate 56 is drawn along the lateral plate 502 of the carriage 50, vertically bent, and secured to the carriage 50 by the base cover 52. At this time, the flexible substrate 56 is provided with a temporary fixing convex portion 563, and can be secured by fixing the convex portion 563 in the carriage 50, whereby the efficient assembly can be made in attaching the base cover 52. Further, the base cover 52 is provided with a rubber pad 57 and presser portions 521 for preventing the falling of the pins 506 on the carriage 50 to fit with respective positioning holes of the flexible substrate 56. Also, the head cartridge 7 of the present invention is provided with a concave portion 731 for escaping the projected portion of the positioning pin 506 and the presser portion 521 of the base cover 52. Accordingly, the length of the positioning pins 506, and the thickness of the presser portion 502 for the base cover 52 can be reserved more fully, so that the correct positioning of the rubber pad 57 and the flexible substrate 56 and the prevention of the falling of the pins can be achieved. The flexible substrate 56 is secured to the chassis 8 by a flexible fixture plate 85 (see FIG. 2), with its curvature varied in accordance with the position of the carriage portion 15, to transmit a head drive signal from the electrical substrate 9 to the head cartridge 7, corresponding to the movement of the carriage portion 15 (see FIG. 3).

With the above constitution, the coupling, holding and positioning of the head cartridge 7 on the carriage portion 15 and the electrical contact therebetween can be easily made.

Next, the operation of the replacement of the head cartridge will be described. When the ink is exhausted within the recording head, and when the replacement of the color recording head used is needed, the operator depresses a predetermined key switch for the replacement of head cartridge. Normally, the head cartridge is on standby at the capping position, but the carriage is moved to a head cartridge replacement position.

FIGS. 5A and 5B show front views of the carriage portion 15 upon coupling. In mounting the head cartridge 7, the hook lever 53 is moved upward as shown in the figure to draw the head holder 51 to the left in the figure (i.e., to the left as looked from the front side of the recording apparatus main body) to enable the mounting of the head cartridge 7 (FIG. 5A). In this state, if the head cartridge 7 is mounted and the hook lever 53 is rotated downward, the head holder 51 is moved to the right along with the head cartridge 7 to enable the positioning and the electrical contact of the head cartridge 7 (FIG. 5B). In this state, the image can be formed on the recording sheet P. Further, when the head cartridge 7 is removed from the carriage portion 15, the hook lever 53 is moved upward as shown in FIG. 5A, and the head holder 51 is moved to the left. Thereby, the guide arm 513 of the head holder 51 forces the head cartridge 7 to the left, so that the recording head is disengaged from the contact portion of the carriage portion 15. In this state, the operator can take out the head cartridge 7 in a direction perpendicular to the slide direction of the head holder 51. Then, at the replacement position of the head cartridge, the platen 34 is provided with a concave portion 34*a* as shown in FIG. 1 opposite the face plane of the head cartridge 7. The depth is 0.5 mm to 2 mm, and the width is greater than the width of the face plane of the head cartridge plus the slide amount necessary to release the engagement of the head cartridge. Accordingly, when the operator replaces the recording head, there is less risk that the face plane of the head cartridge 7 may rub against the guide plane of the platen 34, thereby eliminating the damage of the head face plane to degrade the recording quality. Further, the operator mounts a new head cartridge 7. In this case, there is also less risk that the face plane of the head cartridge may rub against the guide plane, as above described. For example, if the hook lever 53 is rotated downward as shown in FIG. 5A, the head holder 51 is moved to the right along with the cartridge 7 to enable the positioning and electrical contact of the head cartridge. If the operator depressed the key switch for the replacement of recording head after the replacement is completed, the carriage returns to the capping position to effect the capping.

A paper gap adjusting portion 58 for adjusting the gap betweeen the head cartridge 7 and the recording sheet P is provided on an upper portion of the carriage 50. The paper gap adjusting portion 58 is comprised of an adjusting lever 581, a pressure contact lever 582, a pressure contact spring 583, and a top cover 584.

The adjusting lever 581 has a pin inserted into a hole provided on the carriage 50 and is configured to be rotatable. The adjusting lever 581 has a sliding surface 585 of a polygon having different distances from the rotational center of the adjusting lever in accordance with the number of paper gap positions. The pressure contact lever 582 is rotatable about the pin provided on the carriage 50, the sliding surface 585 of the adjusting lever 581 being biased by the pressure contact spring 583 to the guide rail 82. By changing the sliding surface 585 of the adjusting lever 581, the carriage 50 is rotated around the guide shaft 81 so that the gap between papers can be varied. A top cover 584 is secured to the carriage 50 by claws on both sides to carry the adjusting lever 581 and the pressure contact lever 582. Further, the lever top end portion of the adjusting lever 581 has elasticity to secure the adjusting lever 581 corresponding to a groove 586 of the top cover 584 to form a predetermined gap between papers.

The carriage portion 15 can be scanned in reciprocative motion by passing a bearing of the carriage 50 through the guide shaft 81 attached to the chassis 8 by sliding the adjusting lever 581 and the pressure contact lever 582 on the guide rail 82 attached to the chassis 8 as well. A timing belt 83 is attached on the back surface of the carriage 50. The timing belt 83 is suspended around a pulley 801 disposed on the shaft of a carriage motor 80 attached to the chassis 8, and an idle pulley 84 to stretch the timing belt 83 attached to the chassis 8.

As above described, in an ink jet recording apparatus of this embodiment, the replacement position of the head cartridge is provided at a position different from the capping position of the head (not provided with the capping member), whereby the replacement operation can be easily performed.

Also, in replacing the head cartridge 7, the head cartridge 7 is only moved in the main scan direction without revolving the head cartridge 7. Because the movement mechanism of the head cartridge 7 is guided by the guide arm 513, with the concave portion 515 provided at a site corresponding to the ink discharge face of the recording head, the mounting can be correctly made without damaging the head cartridge 7.

Also, in mounting the head cartridge, the flexible substrate 56 will not be damaged due to friction, because the guide arm 513 is disposed between the contact portion 503 to attach the flexible substrate 56 and the head cartridge 7 to be situated without pressing directly the flexible substrate 56.

[Embodiment 2]

Figure 13:
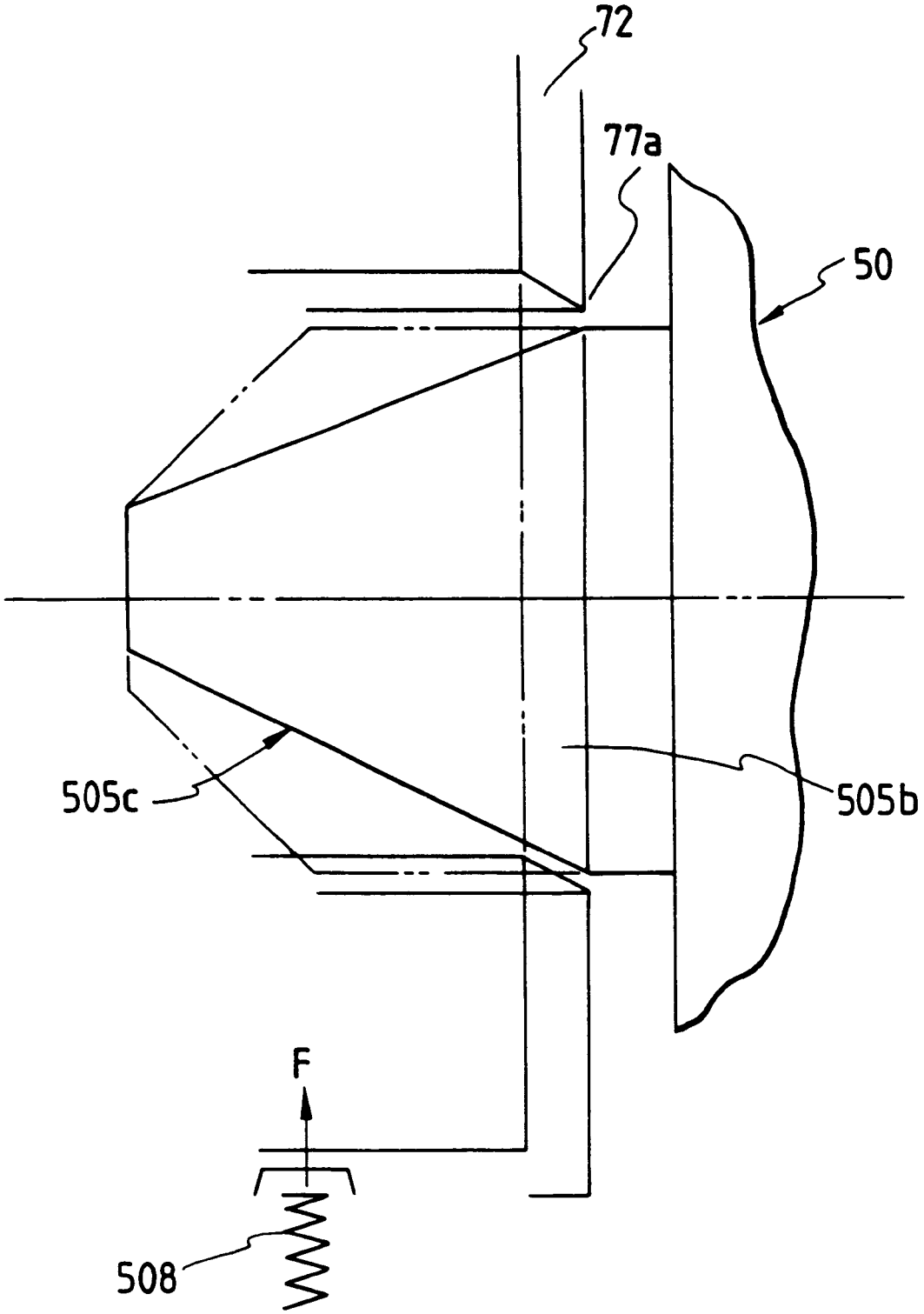
FIG. 13 is a view for explaining the constitution of a head fit pin according to a second embodiment of the present invention.

While in the above-described embodiment only the undercut portion on the mold construction of the carriage 50 is removed for the fit pin 505*b* on the carriage 50 corresponding to the fit hole 77 of the base plate 72 for the head cartridge 7, it will be understood that the taper portion may be provided as a whole as shown in FIG. 13. A constant amount of taper is provided from the start position at which the contact surface 561 of the flexible substrate 56 and the contact surface 78 of the head cartridge 7 abut to the head set position. And pressing means 508 is provided as pressing along the taper surface 505*c*.

With the above constitution, both contact surfaces 78, 561 can slide from the start position at which the contact surface 561 of the flexible substrate 56 and the contact surface 78 of the head cartridge 7 abut to the head set position, while being subjected to a predetermined pressure. Accordingly, both contact surfaces 78, 561 are refreshed every time the head cartridge 7 is mounted or demounted, so that the contact failure due to deposit of foreign matter can be prevented.

Other constitution is the same as in the embodiment 1.

[Embodiment 3]

Figure 14:
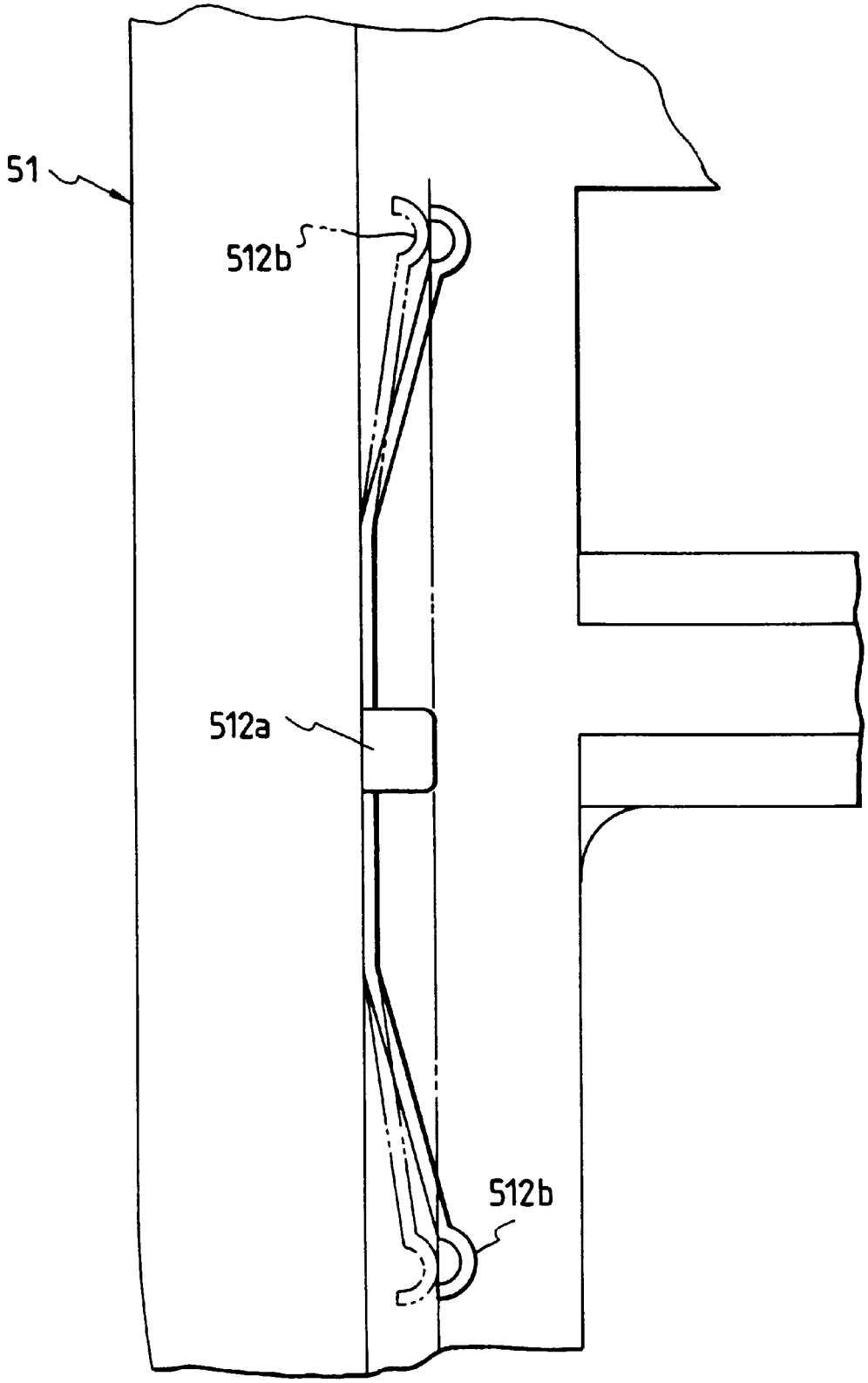
FIG. 14 is a view for explaining the constitution of a head pressure portion according to a third embodiment of the present invention.

While in the embodiment 1, the pressure portion 512 of the head holder 51 for the head cartridge 7 applies pressure at one point, it will be understood that it may apply pressure at multiple points as shown in FIG. 14. Then, if the pressure portion 512 is out of the head holder 51 and has similar rigidity, the head cartridge 7 is difficult to press in well-balanced condition owing to the backlash or deformation of the head holder 51 with respect to the carriage 50. Thus, the pressure portion 512*b* at both ends is provided with an elastic member such as a leaf spring, as shown in FIG. 14. For example, the pressing force of the central pressure portion 512*a* is 1000 to 2000 g, and the pressing force of the pressure portion 512*b* at both ends is 200 to 500 g. The leaf spring of the pressure portion 512*b* at both ends is deformed due to its elasticity to apply a predetermined force to bring the head cartridge 7 into abutment with the central pressure portion 512*a*, as shown in FIG. 14. Also, the position at which the pressure portion 512*b* at both ends presses the head cartridge 7 is desirably outside the neighborhood of two positioning surfaces 504*a, b* of the carriage 50 on the base plate 72 of the head cartridge 7.

With the above constitution, the head cartridge can be held more stably. Other constitution is the same as in the embodiment 1.

[Embodiment 4]

Figure 15:
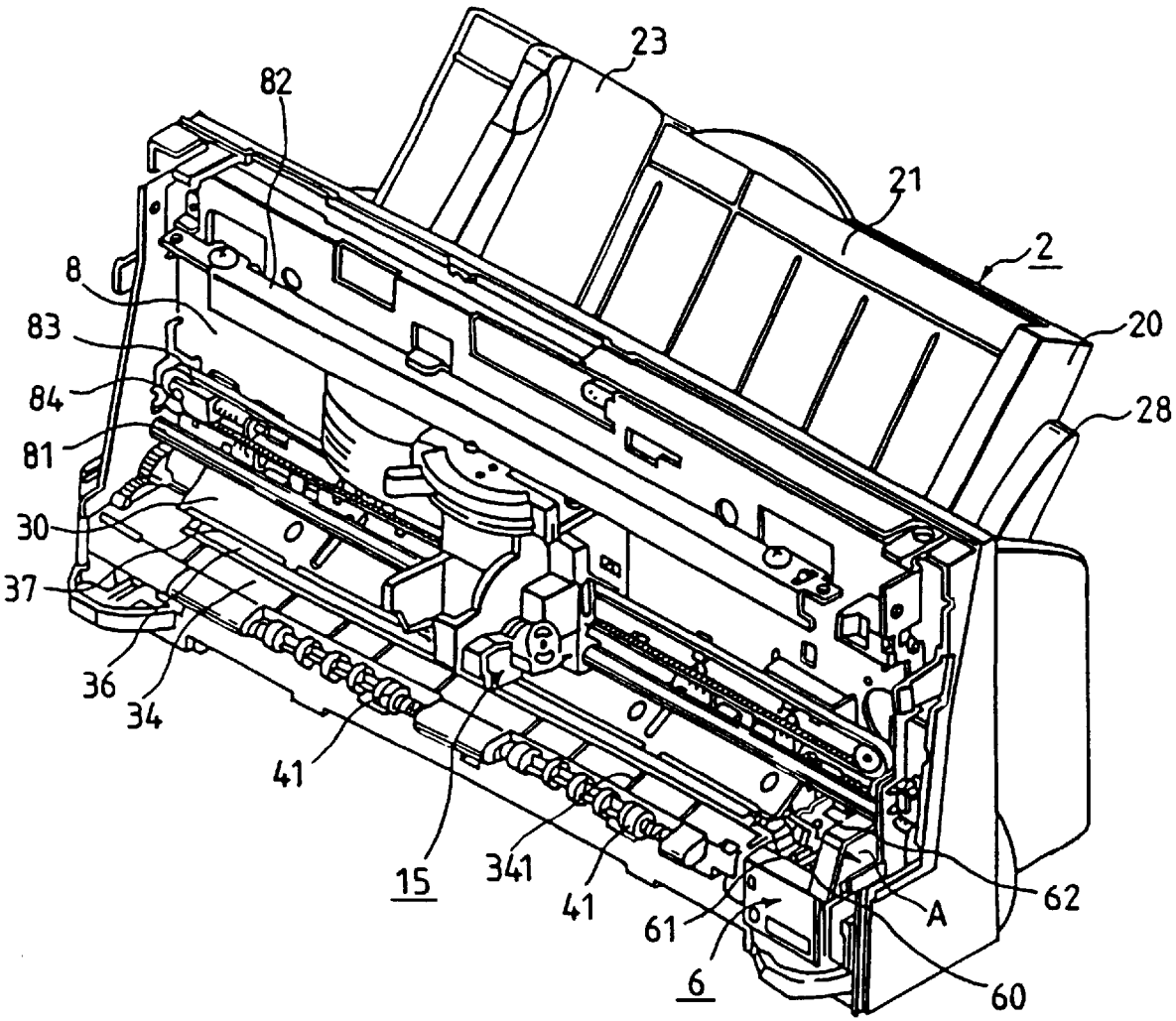
FIG. 15 is a perspective view showing the overall constitution of a recording apparatus according to a fourth embodiment of the present invention.
Figure 16:
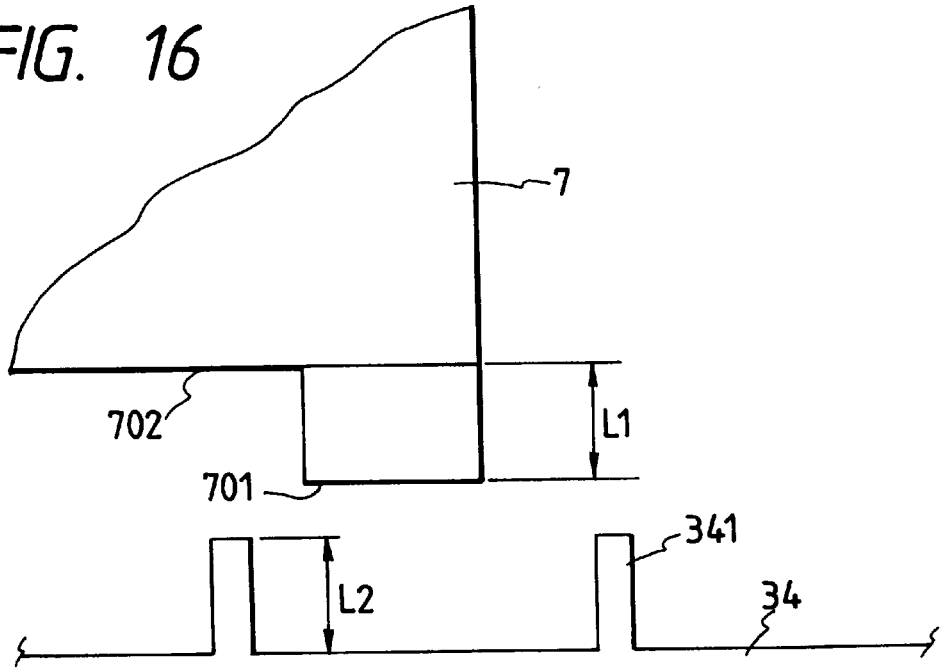
FIG. 16 is a front view showing the positional relation between the head and the platen according to the fourth embodiment of the present invention.

While in the embodiment 1, the concave portion 34*a* is provided on a part of guide means, it will be appreciated that a plurality of ribs 341 extending in the sub-scan direction may be provided on the platen (guide means), and a plurality of concave portions 34*a* may be provided by the faces lying between these ribs, as shown in FIG. 15. If the recording sheet can slide on the plurality of ribs, the sliding resistance of the recording sheet is equalized as a whole, and has no effect on the conveying performance. Also, the step $L_1$ between a first top end face closest to the guide face of the guide means for the head cartridge 7 and a second top end face secondly closest thereto may be greater than the depth $L_2$ of the concave portion of the guide means ($L_1>L_2$), as shown in FIG. 16. In this case, even if the second top end face abuts against the guide face, the first top end portion does not make contact with the bottom of the concave portion, so that the face plane of the head cartridge 7 is never damaged upon coupling. Other embodiment is the same as the embodiment 1.

[Embodiment 5]

Figure 17:
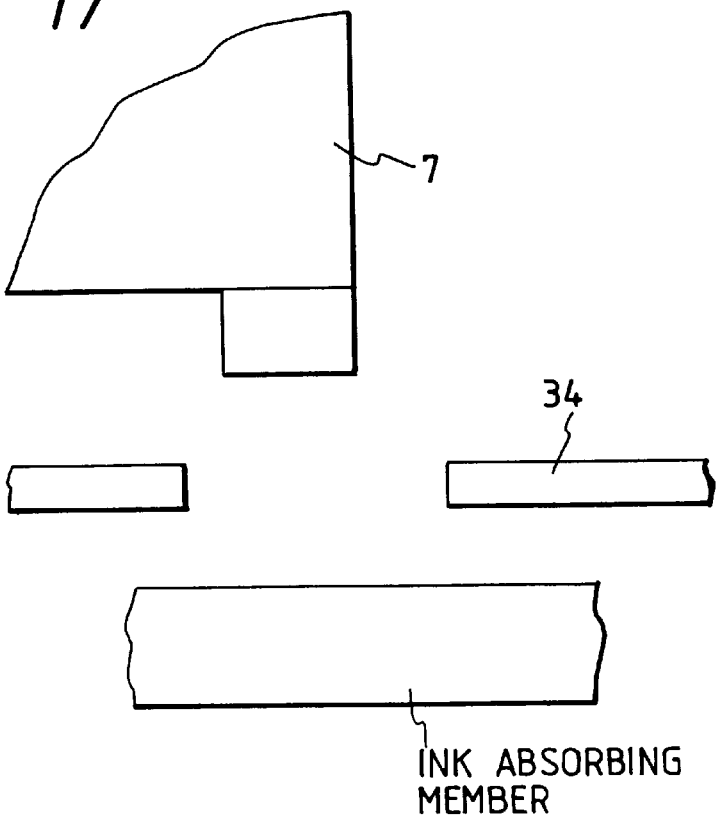
FIG. 17 is a front view showing the positional relation between the head and the platen according to a fifth embodiment of the present invention.

While in the above embodiment, the concave portion having the bottom in a part of the guide means is provided, it will be appreciated that a through hole may be provided, with an ink absorbing member at its top end, as shown in FIG. 17. With such a construction, if the ink tank is pressurized due to some reason in replacing the recording head to cause the ink to flow out of the nozzle face of the recording head, the ink can be held into the absorbing member.

[Embodiment 6]

While in each of the above embodiments, the so-called serial type printer in which the head cartridge mounted on the carriage is scanned in the main scan direction to make the recording has been described, it will be appreciated that the present invention is also applicable to the full-line type printer in which the recording elements are arranged over the length corresponding to the recordable width of the recording sheet. That is, the present invention can be suitably applied to the member having the full-line head mounted on the pinter.

[Embodiment 7]

The fit pins 505*a*, 505*b* are provided to make the positioning of the recording head 7 on the lateral plate 502 of the carriage 50, as shown in FIG. 7. On the other hand, the base plate 72 of the recording head 7 is attached inclinedly at an angle of 1° to 4° to the conveying direction of the recording sheet P, as shown in FIGS. 4A to 4D. To correspond to that angle, one fit pin 505*a* is made a square shape having a cylindrical shape 2505*d* partly, while the other fit pin 2505*b* is made a round shape having a taper, as shown in FIG. 19B. And the base plate 72 of the recording head 7 is formed with a square hole into which the square fit pin 2505*a* is fitted, and a round hole into which the round fit pin 2505*b* is fitted. The position of the recording head 7 is restrained in one direction perpendicular to the fitting direction between the fit pin 2505*a* and the square hole formed in the base plate 72 by the square fit pin 2505*a* being fitted into the square hold formed in the base plate 72, while the position of the recording head 7 is restrained in the second direction perpendicular to the fitting direction between the fit pin 2505*b* and the round hole formed in the base plate 72 by the round fit pin 2505*b* being fitted into the round hole formed in the base plate 72. That is, the first fitting means is comprised of the square fit pin 2505*a* and the square hole formed in the base plate 72, and the second fitting means is comprised of the round fit pin 2505*b* and the round hole formed in the base plate 72.

Figure 19A:
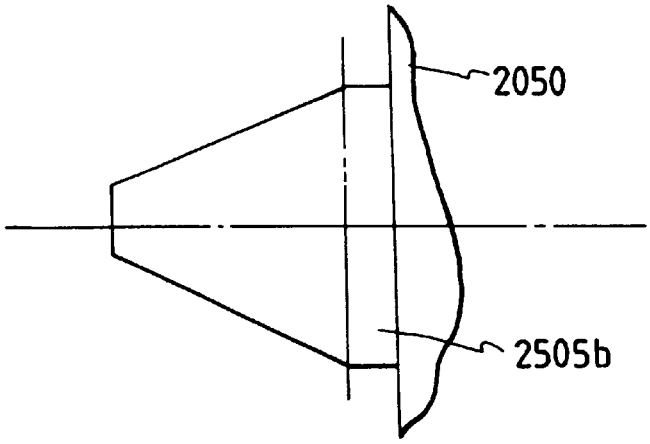
Figure 19B:
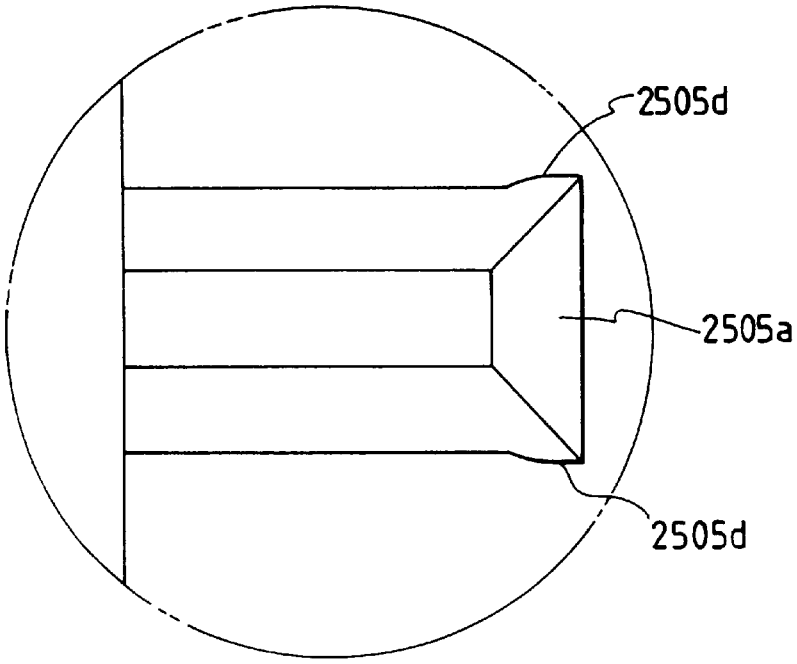

Also, particularly for the round fit pin 2505*b*, an undercut portion on the mold construction of the carriage 50 is removed to make the fitting at the position where the recording head 7 is abutted against the positioning surface 504*a* of the carriage 50, i.e., at the recording head set position as shown in FIG. 19A. By doing in this way, the correct and smooth positioning of the recording head 7 to the inclined base plate 72 can be made without needing any complex mold construction. Further, the taper portion of the fit pin 2505*b* is provided as a whole so that a constant amount of taper may be given from the start position at which the contact portion 61 of the flexible substrate 56 and the contact surface 78 of the recording head 7 abut to the recording head set position.

Figure 18B:
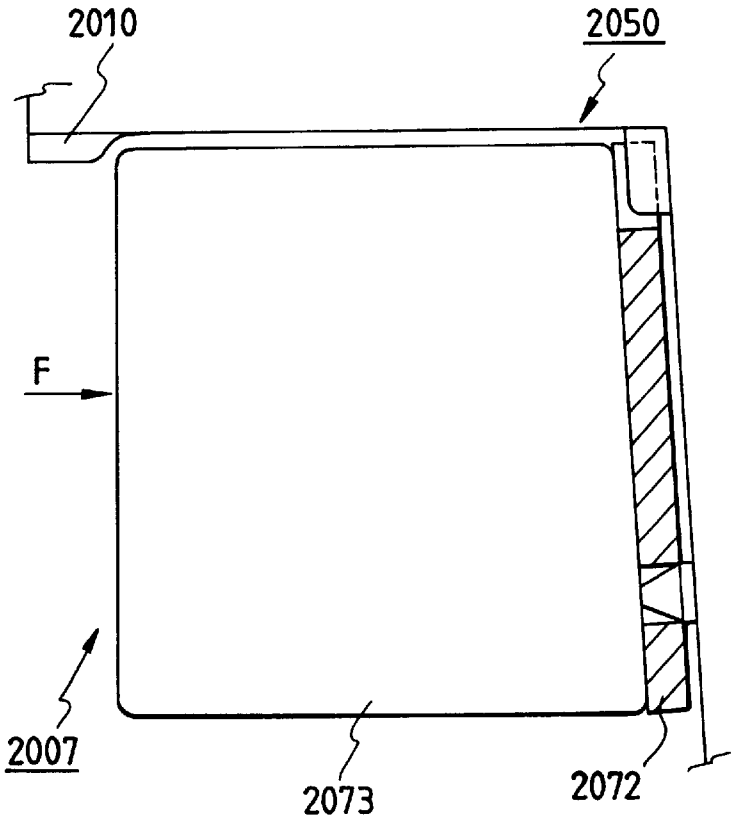
FIGS. 18A and 18B are typical views showing a fitting portion of the carriage with the recording head in the recording apparatus as shown in FIG. 1, according to a seventh embodiment of the present invention, as well as its positioning operation.
Figure 18A:
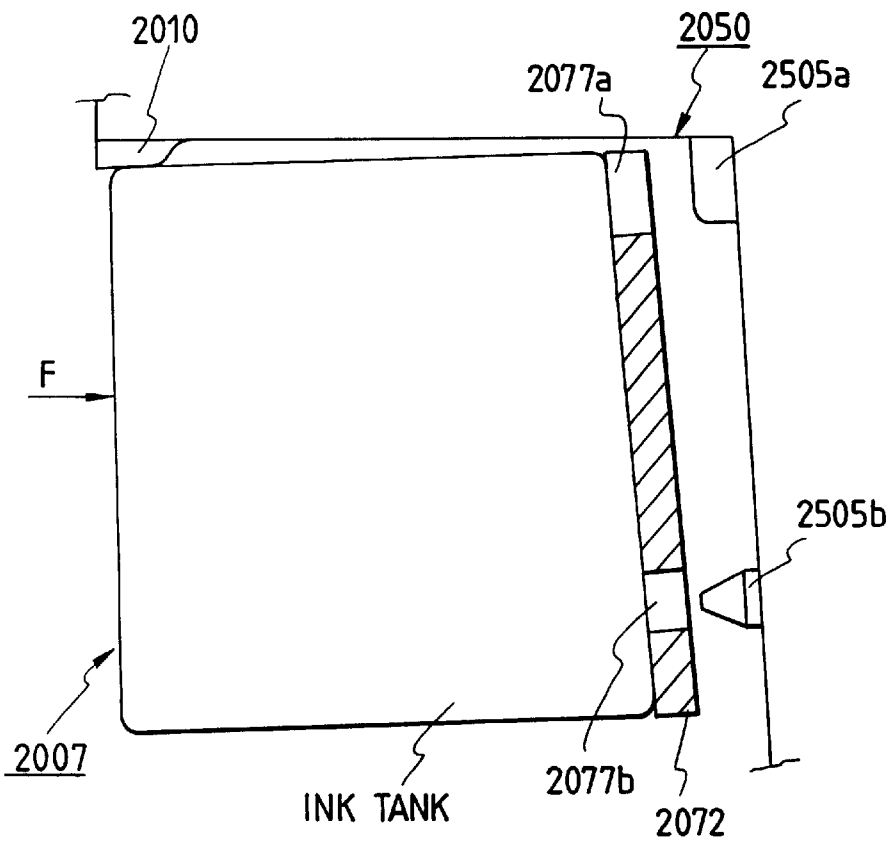

In mounting the recording head 7, the hook lever 53 is pulled up to move the head holder 51 to the left, as shown in FIG. 5A. In this state, the recording head 7 is mounted within the head holder 51. Then, if the hook lever 53 is rotated downward, the head holder 51 is moved to the right along with the recording head 7 to make the positioning and electrical contact of the recording head 7, as shown in FIG. 5B. This operation is typically shown in FIGS. 18A and 18B. That is, in the state where the head holder 2051 is positioned to the left, the recording head 2007 abuts on a projection 2010 extending from the carriage 2050, as shown in FIG. 18A, so that the recording head 2007 is mounted slightly inclinedly to the fit pin 2505*b*. If the recording head 2007 is moved to the right due to a pressing force F from the head holder 2051 in this state, the fit pin 2505*b* is necessarily first fitted into the round hole 2077*b*, with only small sliding resistance or loss of force, so that the recording head 2007 can be placed correctly at the normal position. As a result, the printing failure, such as offset ruled line, due to false set position of the recording head 2007 can be eliminated. Further, the projection 2010 is out of contact with the recording head 2007 at the normal position where the recording head 2007 is set is shown in FIG. 18B, so that the recording head 2007 is not incompletely set while being restrained by the projection 2010.

On the other hand, when the recording head 2007 is taken away from the carriage 2050, the hook holder 2053 is pulled up as shown in FIG. 5A to move the head holder 51 to the left, whereupon the recording head 2007 is removed from the head holder 2051.

[Embodiment 8]

Figure 20B:
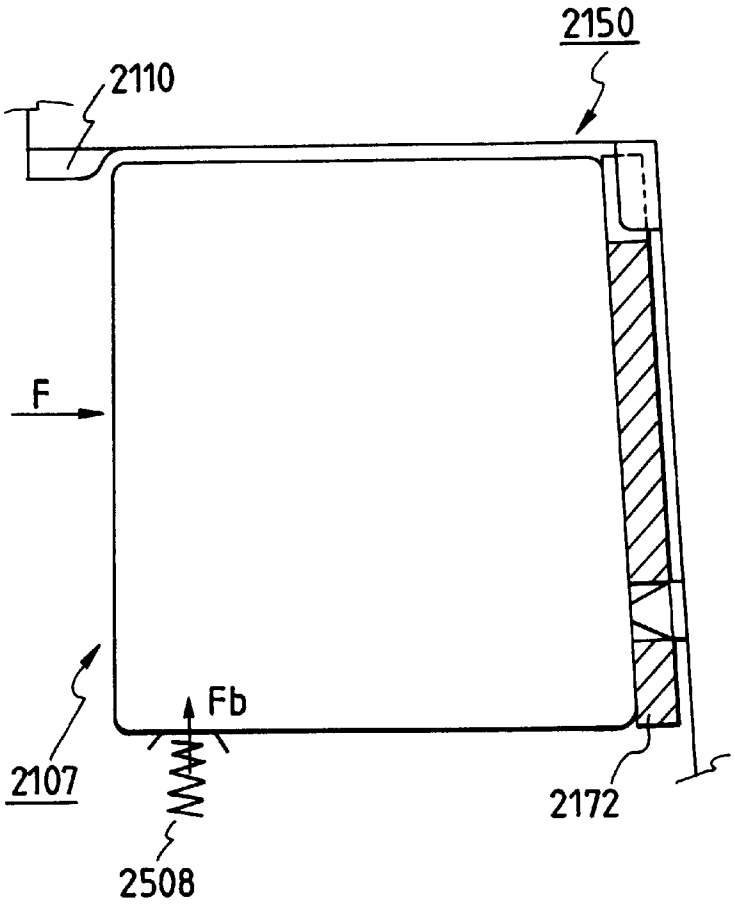
FIGS. 20A and 20B are typical views showing a fitting portion of the carriage with the recording head in a recording apparatus according to an eighth embodiment of the present invention as well as its positioning operation.
Figure 20A:
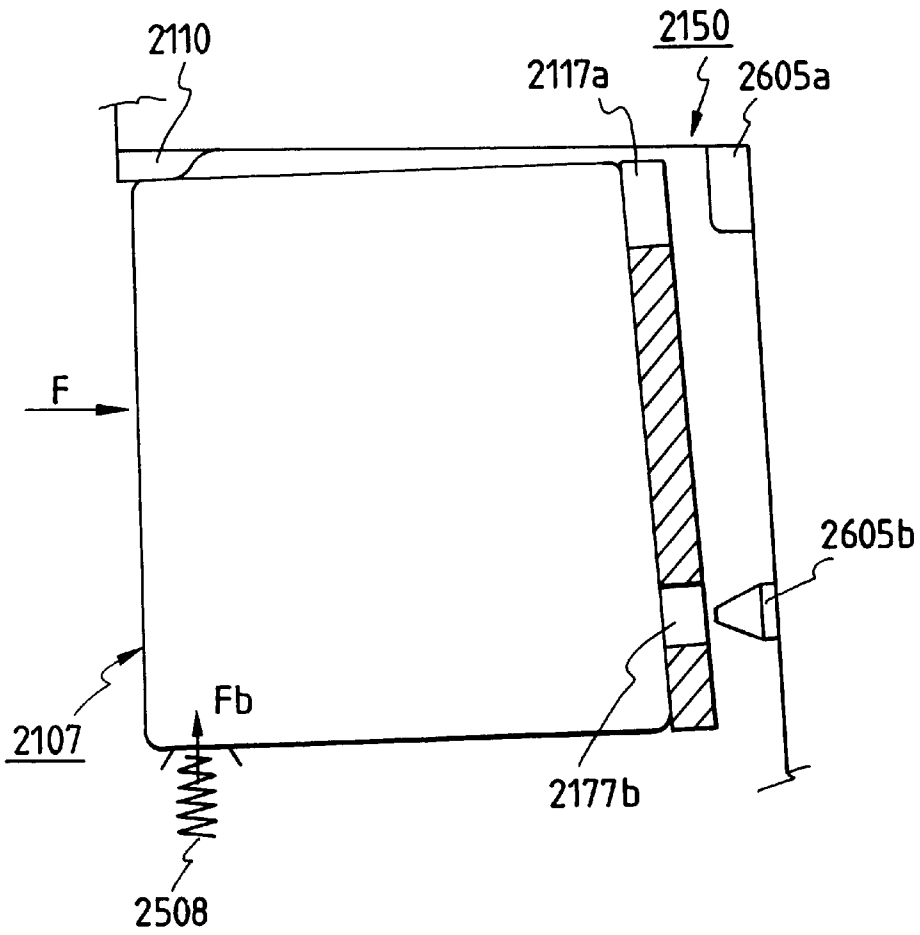

FIGS. 20A and 20B are views showing schematically a fitting portion between the carriage and the recording head, as well as its positioning operation, in the eighth embodiment of the recording apparatus of the present invention.

This embodiment is different from the first embodiment in that a pressure coil spring 2508 is added at a site opposed to the projection 2110 of the head holder (not shown) as pressing means for pressing the recording head 2107 against the projection 2110 of the carriage 2150. Other constitution is the same as in the first embodiment.

With the above constitution, since the fit pin 2605*b* is first fitted into the round hole 2177*b* more securely, the recording head 2010 can be positioned more correctly at the normal position. Note that the pressing means is not limited to the coil spring, but may be a leaf spring.

[Embodiment 9]

Figure 21B:
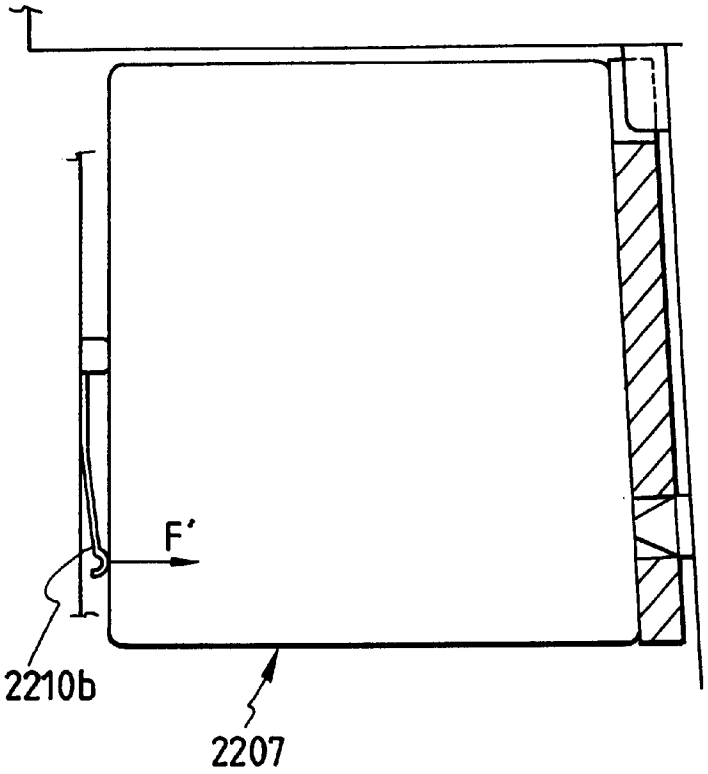
FIGS. 21A and 21B are typical views showing a fitting portion of the carriage with the recording head in a recording apparatus according to a ninth embodiment of the present invention, as well as its positioning operation.
Figure 21A:
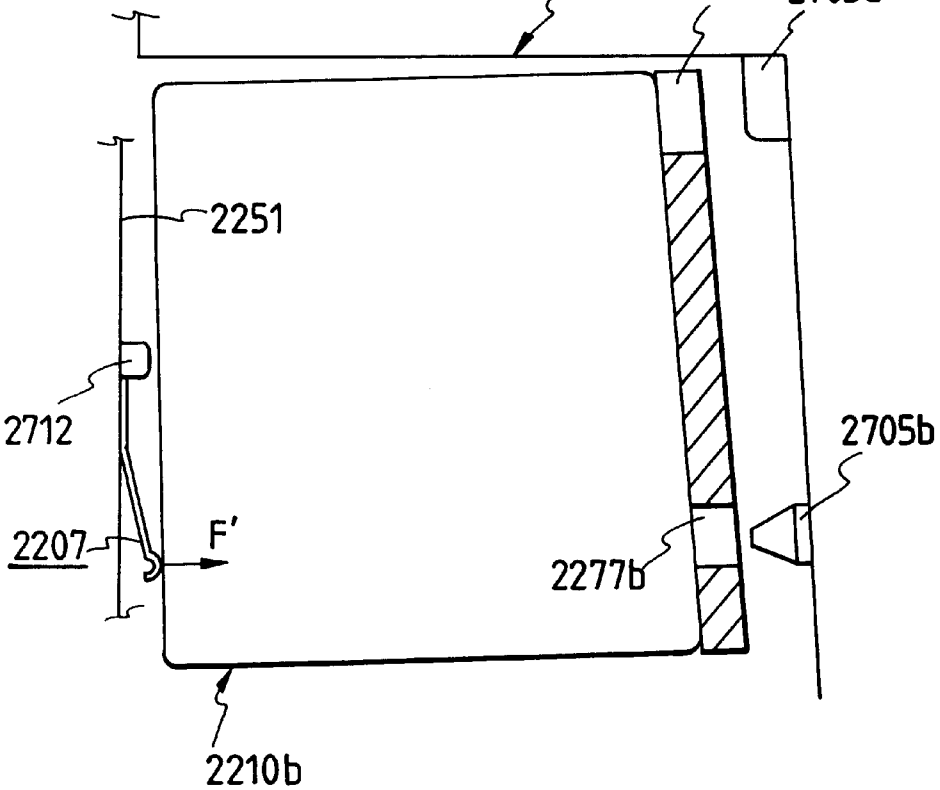

FIGS. 21A and 21B are views showing schematically a fitting portion between the carriage and the recording head, as well as its positioning operation, in the ninth embodiment of the recording apparatus of the present invention.

In this embodiment, restraining means is provided on the head holder 51, rather than on the head holder 2251. That is, a pressure leaf spring 2210*b* with its top end portion abutting on the portion of the recording head 2207 opposite the round hole 2277*b* is secured to the pressing portion 2712 of the head holder 2251, as biasing means for biasing the portion of the recording head 2207 opposite the round hole 2277*b* toward the fit pin 2705*a*. Other constitution is the same as in the first embodiment.

With the above constitution, the recording head 2207 mounted within the head holder 2251 is biased on the portion opposite the round hole 2277*b* to the right in the figure by a force F' of the pressure leaf spring 2210*b*, and is mounted inclinedly to the side of the fit pin 2705*b* as shown in FIG. 21A. If the head holder 2251 is moved to the right in this state, the fit pin 2705*b* is first fitted into the round hole 2277*b*, so that the recording head 2207 is placed correctly at the normal position. In the state where the recording head 2207 is positioned, the pressure leaf spring 2210*b* is elastically deformed by the recording head, as shown in FIG. 21B, with the recording head 2207 abutting on the pressing portion 2210*b*. The pressing force of the pressure leaf spring 2210*b* to the recording head 2207 is 200 to 500 g, for example, and the pressing force of the pressing portion 2712 to the recording head 2207 in the state where the recording head 2207 is positioned is 1000 to 2000 g, for example.

Note that in this embodiment, biasing means is not limited to a leaf spring, but may be a coil spring. Also, it will be appreciated that the mounting position of the biasing means may be directly made on the side face of the head holder, rather than the pressing portion 2712.

In the above embodiments, the fit pin is provided in the carriage and the fit hole is provided in the recording head, but reversely, the fit pin may be provided in the recording head and the fit hole may be provided in the carriage. Also, while the recording apparatus of the ink jet system is exemplified, the present invention is not limited thereto, but may be also applicable to the recording apparatus of the wire dot system or the thermal system, as far as the recording apparatus can mount the detachable recording head.

The present invention brings about excellent effects particularly in a recording head or a recording device of the ink jet system of performing the recording by forming fine ink droplets by utilizing the heat energy among the various ink jet recording systems.

As to its representative constitution and principle, for example, one practiced by use of the basic principle disclosed in, for example, U.S. Pat. Nos. 4,723,129 and 4,740,796 is preferred. This system is applicable to either of the so-called on-demand type and the continuous type. Particularly, the case of the on-demand type is effective because, by applying at least one driving signal which gives rapid temperature elevation exceeding nucleus boiling corresponding to the recording information on electricity-heat converters arranged corresponding to the sheets or liquid channels holding a liquid (ink), heat energy is generated at the electricity-heat converters to effect film boiling at the heat acting surface of the recording head, and consequently the bubbles within the liquid (ink) can be formed corresponding one by one to the driving signals. By discharging the liquid (ink) through an opening for discharging by growth and shrinkage of the bubble, at least one droplet is formed. By making the driving signals into the pulse shapes, growth and shrinkage of the bubbles can be effected instantly and adequately to accomplish more preferably discharging of the liquid (ink) particularly excellent in response characteristic.

As the driving signals of such pulse shape, those as disclosed in U.S. Pat. Nos. 4,463,359 and 4,345,262 are suitable. Further excellent recording can be performed by employment of the conditions described in U.S. Pat. No. 4,313,124 of the invention concerning the temperature elevation rate of the above-mentioned heat acting surface.

As the constituion of the recording head, in addition to the combination of the discharging port, liquid channel, and electricity-heat converter (linear liquid channel or right-angled liquid channel) as disclosed in the above-mentioned respective specifications, the constitution by use of U.S. Pat. Nos. 4,558,333 or 4,459,600 disclosing the constitution having the heat acting portion arranged in the flexed region is also included in the present invention.

In addition, the present invention can be also effectively made the constitution as disclosed in Japanese Laid-Open Patent Application No. 59-123670 which discloses the constitution using a slit common to a plurality of electricity-heat converters as the discharging portion of the electricity-heat converter or Japanese Laid-Open Patent Application No. 59-138461 which discloses the constitution having the opening for absorbing pressure wave of heat energy correspondent to the discharging portion.

Further, as the recording head of the full line type having a length corresponding to the maximum width of a recording medium which can be recorded by the recording device, the present invention can exhibit the above effects further effectively with either the constitution which satisfies its length by a combination of a plurality of recording heads as disclosed in the above-cited specifications or the constitution as one recording head integrally formed.

In addition, the present invention is effective for a recording head of the freely exchangeable chip type which enables electrical connection to the main device or supply of ink from the main device by being mounted on the main device, or a recording head of the cartridge type having an ink tank integrally provided on the recording head itself.

Also, addition of a restoration means for the recording head, a preliminary auxiliary means, etc., provided as the constitution of the recording device of the present invention is preferable, because the effect of the present invention can be further stabilized. Specific examples of these may include, for the recording head, capping means, cleaning means, pressurization or suction means, electricity-heat converters or another type of heating elements, or preliminary heating means according to a combination of these, and it is also effective for performing stable recording to perform preliminary mode which performs discharging separate from recording.

Further, as the recording mode of the recording device, the present invention is extremely effective for not only the recording mode only of a primary color such as black, etc., but also a device equipped with at least one of plural different colors or full color by color mixing, whether the recording head may be either integrally constituted or combined in plural number.

In addition, though the ink is considered as the liquid in the embodiments as above described, other inks may be also usable which are solid below room temperature and will soften or liquefy at or above room temperature, or liquefy when a recording signal used is issued at it is common with the ink jet device to control the viscosity of ink to be maintained within a certain range of the stable discharge by adjusting the temperature of ink in a range from 30° C. to 70° C.

In addition, in order to avoid the temperature elevation due to heat energy by positively utilizing the heat energy as the energy for the change of state from solid to liquid, or to prevent the evaporation of ink by using the ink which will stiffen in the shelf state, the use of the ink having a property of liquefying only with the application of heat energy, such as those liquefying with the application of heat energy in accordance with a recording signal so that liquid ink is discharged, or will already solidify prior to reaching the recording medium, is also applicable in the present invention. In such a case, the ink may be held as liquid or solid in recesses or through holes of a porous sheet, which is placed opposed to electricity-heat converters, as described in Japanese Laid-Open Patent Application No. 54-56847 or No. 60-71260. The most effective method for the inks as above described in the present invention is based on the film boiling.

Additionally, the recording apparatus according to the present invention may be used integrally or separately as an image output terminal in an information processing equipment such as a word processor or a computer, a copying machine in combination with a reader, or a facsimile terminal equipment having the transmission and reception feature. Also, the present invention is not limited to the above embodiments, but allows for various variations, and these variations can offer other effects than those as described below without departing from the scope of the present invention.

As above described, the present invention has restraining means for fitting second fitting means prior to first fitting means, in mounting the recording head in the holding means, with reduced sliding resistance or loss of force when fitting each fitting means, so that the recording head can be positioned correctly at a predetermined position. As a result, no misregistration of the recording head at the set position will occur, and the printing failure such as offset ruled line due to the false set position can be prevented.

Also, by providng pressing means for pressing the recording head against the projection when the projection is used as the restraining means, the recording head can be abutted against the projection securely to cause the second fitting means to be first fitted more securely. Further, the recording head can be positioned at a predetermined position without being restrained by the projection in the state where the recording head is positioned by providing the projection at a position out of contact with the recording head in the state where the recording head is positioned.

The effects of each component of the present invention will be cited below, but the present invention is more preferably made by having at least one of the following components.

(1) A recess portion lower than the recording sheet conveying guide plane is provided on a part of guide means opposed to the recording head at the replacement position of the head cartridge, whereby there is no risk that the face plane of the recording head may fall down and rub against the guide plane of guide means in coupling or decoupling the recording head, thereby damaging the face plane to degrade the printing quality.

(2) The replacement position of the head cartridge is provided within the printing area, whereby the apparatus size can be kept from becoming larger.

(3) The guide plane of guide means is comprised of a plurality of ribs, with the head cartridge replacement position between these ribs, whereby there is no difference in sliding resistance between the recording sheet and the guide means so that the excellent conveyance of the recording sheet can be accomplished.

(4) The concave portion of the guide plane is made a through hole, with an ink absorbing member provided in front of it, whereby if the ink flows out of the nozzle face of the recording head as the ink tank is pressurized due to some reason when replacing the recording head, the ink can be held into the absorbing member.

(5) The contact surface of the head is within the notch portion of the base plate, whereby the contact surface of the carriage can be easily placed into contact with the concave portion.

(6) The notch portion of the base plate is configured to surround the contact surface in three directions, without problems regarding the processing for the end portion of the flexible substrate, whereby the excellent contact can be established.

(7) The fit pin on the carriage side is tapered, whereby any complex geometry on the mold construction can be avoided to cope with the fit hole for positioning the inclined base plate. Further, pressing means is provided as along the taper face, whereby the contact surface of the flexible substrate and the contact surface of the recording head can be refreshed every time the recording head is mounted or demounted, so that the contact failure due to deposit of foreign matter can be presented.

(8) The pressing means, pressing position, and pressing method allow the correct contact and positioning to be made.

(9) The means for covering the contact means and the positioning means from the direction of mounting the recording head is provided, whereby the user does not need directly touch the contact means and the positioning means, so that the contact failure or positioning failure can be prevented.

Accordingly, the present invention can provide a superior recording apparatus for outputting high quality image on the recording medium without losing excellent characteristics provided by the ink jet recording head, and an information processing system such as a copying machine, a facsimile, a printer, a word processor, and a personal computer comprising said recording apparatus as output means.

What is claimed is:

1. A recording apparatus comprising:

holding means for detachably holding a recording head or forming an image on the recording medium;

positioning means for positioning said recording head at a predetermined position of said holding means in mounting said recording head on said holding means, said positioning means having a first fitting means for restraining said recording head in a first direction and a second fitting means for restraining said recording head in a second direction; and restraining means for fitting said second fitting means prior to said first fitting means in mounting said recording head on said holding means is provided, wherein said first fitting means and said second fitting means are located on a surface not perpendicular to a positioning direction after fitting, said second fitting means has a columnar shape projecting in a fitting direction and having a tapered portion converging to a leading end thereof, said first fitting means has a positioning surface projecting in the fitting direction at a position of said surface for positioning said head and having a tapered portion converging to a leading end thereof, and the fitting direction is not perpendicular to said surface.

2. A recording apparatus according to claim 1, wherein each of said fitting means comprises comprised of a fit pin and a fit hole.

3. A recording apparatus according to claim 2, wherein said fit pin is of tapered shape.

4. A recording apparatus according to any one of claims 1 to 3, wherein said restraining means is a projection extending from said holding means so that said recording head may be tilted in a sense closer to said second fitting means than said first fitting means by abutment of said recording head.

5. A recording apparatus according to claim 4, further comprising pressing means, at a position opposed to said projection, for pressing said recording head against said projection.

6. A recording apparatus according to claim 5, wherein said projection lies out of contact with said recording head in a state where said recording head is positioned at a predetermined position of said holding means.

7. A recording apparatus according to claim 4, wherein said projection lies out of contact with said recording head in a state where said recording head is positioned at a predetermined position of said holding means.

8. A recording apparatus according to any one of claims 1 to 3, wherein said restraining means comprises urging means for urging said recording head toward said second fitting means.

9. A recording apparatus according to claim 1, further comprising:

a carriage for carrying said recording head thereon;

coupling means for coupling said recording head at a predetermined replacement position of said holding means; and electrical contact means for transmitting an electric signal to said recording head upon making contact with an electrical contact surface of said recording head mounted on said carriage, wherein said coupling means comprises a holding member for holding said recording head to move in a predetermined direction to place said positioning means and said recording head to be contacted and cause said recording head to be mounted on said carriage, and said holding member comprises an arm for detachably holding said recording head, and a positioning member of placing said recording head at a predetermined position on said holding member.

10. A recording apparatus according to claim 9, wherein the movement direction of said holding means is perpendicular to a direction of mounting said recording head.

11. A recording apparatus according to claim 9 or 10, further comprising means for covering said contact means and said positioning means from the direction of mounting said recording head.

12. A recording apparatus according to claim 11, further comprising pressure means, provided on a plane of said carriage opposed to said contact means and said positioning means, for pressing said recording heads in a predetermined direction.

13. A recording apparatus according to claim 12, further comprising pressure means, provided on a plane of said carriage opposed to said contact means and said positioning means, for pressing said recording head in a predetermined direction.

14. A recording apparatus according to claim 13, wherein said pressure means comprises a plurality of pressure means including rigid pressure means and elastic pressure means.

15. A recording apparatus according to claim 12, wherein said pressure means comprises a plurality of pressure means including rigid pressure means and elastic pressure means.

16. A recording apparatus according to claim 9 or 10, further comprising pressure means, provided on a plane of said carriage opposed to said contact means and said positioning means, for pressing said recording head in a predetermined direction.

17. A recording apparatus according to claim 16, further comprising pressure means, provided on a plane of said carriage opposed to said contact means and said positioning means, for pressing said recording head in a predetermined direction.

18. A recording apparatus according to claim 17, wherein said pressure means comprises a plurality of pressure means including rigid pressure means and elastic pressure means.

19. A recording apparatus according to claim 16, wherein said pressure means comprises a plurality of pressure means including rigid pressure means and elastic pressure means.

20. A recording apparatus according to claim 9, wherein said positioning means corresponding to a positioning fit hole provided on said recording head is a tapered fit pin having a predetermined fit dimension at a positioning site of said recording head.

21. A recording apparatus according to claim 20, further comprising means for contacting a part of the fit hole for said recording head on a taper plane of said tapered fit pin.

22. A recording apparatus according to claim 9, wherein said holding means includes guide means for attaching said recording head to said holding means and restraining means for restraining the positional deviation from said attaching position.

23. A recording apparatus according to claim 9, wherein the width of said contact means is smaller in a direction of a signal line toward the top end.

24. A recording apparatus according to claim 9, wherein said contact means has a flexible substrate with an engagement portion provided at the top end of said flexible substrate, and a slit for inserting and engaging said engagement portion at the top end is provided on said coupler means or said contact means.

25. A recording apparatus according to claim 24, wherein the top end of said flexible substrate is movable in a direction of inserting said slit.

26. A recording apparatus according to claim 9, wherein a guide portion and a restraining portion corresponding to guide means and restraining means of said coupler means are provided on said recording head.

27. A recording apparatus according to claim 26, wherein said guide means opposed to said recording head has a recording medium conveying guide plane contacting with said recording medium, and is formed with at least one recess portion in an area on said recording medium conveying guide plane opposed to a replacement position along said main scan direction.

28. A recording apparatus according to claim 27, wherein said replacement position is within a printing area of the recording medium.

29. A recording apparatus according to claim 27, wherein said recording head is opposed to said recording medium conveying guide plane of said guide means and has a top end face formed with a step, the height of said step being greater than the depth of said recess portion formed on said recording medium conveying guide plane.

30. A recording apparatus according to claim 29, wherein the width of said recess portion on said recording medium guide plane is greater than the width of said top end face of said recording head plus the movement amount of said recording head in a predetermined direction required to separate said recording head from said carriage.

31. A recording apparatus according to claim 27, wherein said recess portion is formed concavely by at least two ribs among the ribs protruded along said conveying direction on said recording medium conveying guide plane and arranged at a predetermined interval, and a region on said recording medium conveying guide plane between said at least two ribs.

32. A recording apparatus according to claim 27, wherein said recess portion is formed concavely with said suction means as the bottom portion by forming a through hole on said recording medium conveying guide plane and disposing suction means for sucking the ink through said through hole.

33. A recording apparatus according to claim 9, wherein a moving direction of said coupling means is a moving direction of said carriage.

34. A recording apparatus according to claim 9, wherein said arm provided on said holding member has a tapered portion and a recess portion corresponding to a portion of said recording head for discharging ink.

35. A recording apparatus according to claim 9, wherein in a state in which the electrical contact means and the recording head are connected, an arm provided in the holding member is located between the electrical contact surface and the carriage.

36. A recording apparatus according to claim 9, further comprising capping means for capping the recording head at a predetermined capping position, wherein said capping position and the replacement position are different.

37. A recording apparatus according to claim 9, wherein said recording head is a recording head of the ink jet system having discharge ports for discharging the ink and energy generating elements for generating the energy to discharge the ink through said discharge ports, which performs the recording by discharging the ink through said discharge ports by driving said energy generating elements based on the recording signal.

38. An information processing equipment, further comprising a recording apparatus according to claim 9 as output means.

39. A recording apparatus according to claim 1, wherein said recording head is a head cartridge having an ink jet recording head using an electrothermal converting element for causing a film boiling an ink as means for generating energy for discharging ink and an ink tank for supplying ink to said head, said head being integrally provided with said ink tank.

40. An ink tank used in said recording apparatus according to claim 39, wherein said ink tank is provided with a guide member for guiding said head cartridge and removably mounted on a head holder of said recording apparatus and a positioning member for removably positioning said head cartridge in a predetermined position within said head holder, said guide member being provided at least on a side of said ink tank.

41. A recording apparatus using said ink tank according to claim 40, wherein a face surface of said recording head has a member fittable with said positioning member provided on said head holder.

42. A recording apparatus having an arrangement according to claim 1, wherein a face surface of said recording head has a member fittable with said positioning member provided on said head holder.

43. A recording apparatus according to claim 1, wherein a direction normal to said surface is inclined with respect to said positioning direction at an angle approximately in the range 1° to 4°.

44. A recording apparatus according to claim 1, wherein part of said first fitting means has a cylindrical shape.

45. A recording apparatus according to claim 2, wherein said first fitting means has a square fit hole and said second fitting means has a round fit hole.

46. A recording apparatus comprising:

holding means for detachably holding a recording head for forming an image on the recording medium;

positioning means for positioning said recording head at a predetermined position of said holding means in mounting said recording head on said holding means, said positioning means having a first fitting means for restraining said recording head in a first direction and a second fitting means for restraining said recording head in a second direction; and restraining means for fitting said second fitting means prior to said first fitting means in mounting said recording head on said holding means is provided, wherein said first fitting means and said second fitting means are located on a surface not perpendicular to a positioning direction after fitting, said second fitting means is a columnar member projecting in a fitting direction to position said head with respect to said surface in the fitting direction, and said first fitting means is a positioning member projecting in the fitting direction to position said head with respect to rotation about an axis extending from said second fitting means in the fitting direction.

47. A recording apparatus according to claim 46, wherein said recording head is an ink jet recording head performing recording by discharging ink.

48. A recording apparatus according to claim 46, wherein said recording head is an ink jet recording head having an electrothermal converting member for generating thermal energy and discharging ink to record utilizing the thermal energy.

49. A recording apparatus according to claim 46, further comprising:

a carriage for carrying said recording head thereon;

coupling means for coupling said recording head at a predetermined replacement position of said holding means; and electrical contact means for transmitting an electric signal to said recording head upon making contact with an electrical contact surface of said recording head mounted on said carriage, wherein said coupling means comprises a holding member for holding said recording head to move in a predetermined direction to place said positioning means and said recording head to be contacted and cause said recording head to be mounted on said carriage, and said holding member comprises an arm for detachably holding said recording head, and a positioning member of placing said recording head at a predetermined position on said holding member.

50. A recording apparatus according to claim 49, wherein said recording head is an ink jet recording head performing recording by discharging ink.

51. A recording apparatus according to claim 49, wherein said recording head is an ink jet recording head having an electrothermal converting member for generating thermal energy and discharging ink to record utilizing the thermal energy.

* * * * *

UNITED STATES PATENT AND TRADEMARK OFFICE

CERTIFICATE OF CORRECTION

PATENT NO. : 6,113,215
DATED : September 5, 2000
INVENTOR(S) : Yanagi et al.

It is certified that error appears in the above-identified patent and that said Letters Patent is hereby corrected as shown below:

Title page,
Item [56], References Cited, FOREIGN PATENT DOCUMENTS,
"20376719" should read -- A2 0376719 --;
"20379151" should read -- A2 0379151 --;
"262651" should read -- 60-262651 --; and
"5278300" should read -- 5-278300 --.
Item [57], ABSTRACT,
Line 9, "meand" should read -- means --.

Column 1,
Line 16, "image" should read -- images --.
Line 25, "clothe" should read -- cloth, --.
Line 30, "Amount" should read -- Among --.

Column 2,
Line 3, "compubter," should read -- computer, --.

Column 3,
Line 36, "such" should read -- such an --.

Column 4,
Line 58, "comprises" should read -- comprises: --.

Column 5,
Line 39, "a" should read -- an --.
Line 42, "contat" should read -- contact --.

Column 7,
Line 38, "a" should be deleted.

Column 8,
Line 29, "EMBODIMENT" should read -- EMBODIMENTS --.

Column 9,
Line 53, "on to" should read -- onto --.

Column 15,
Line 51, "504a, b" should read -- 504a, 504b --.

Column 16,
Line 7, "embodiment is" should read -- embodiments are --.

UNITED STATES PATENT AND TRADEMARK OFFICE

CERTIFICATE OF CORRECTION

PATENT NO. : 6,113,215
DATED : September 5, 2000
INVENTOR(S) : Yanagi et al.

It is certified that error appears in the above-identified patent and that said Letters Patent is hereby corrected as shown below:

Column 19,
Line 41, "in" should read -- in a --.

Column 20,
Line 3, "an" should read -- the --.
Line 5, "a" should be deleted.

Column 21,
Line 2, "as" should be deleted.
Line 6, "presented." should read -- prevented. --.

Column 21, line 23, through Column 26, line 21,
Please delete all of Claims 1 to 51 and replace them with the following Claims 1 to 69.

1. A recording apparatus comprising:

holding means for detachably holding a recording head for forming an image on the recording medium;

positioning means for positioning said recording head at a predetermined position of said holding means in mounting said recording head on said holding means, said positioning means having a first fitting means for restraining said recording head in a first direction and a second fitting means for restraining said recording head in a second direction; and restraining means for fitting said second fitting means prior to said first fitting means in mounting said recording head on said holding means is provided, wherein said first fitting means and said second fitting means are located on a surface not perpendicular to a positioning direction after fitting, said second fitting means has a columnar shape projecting in a fitting direction and having a tapered portion converging to a leading end thereof, said first fitting means has a positioning surface projecting in the fitting direction at a position of said surface for positioning said head and having a tapered portion converging to a leading end thereof, and the fitting direction is not perpendicular to said surface.

It is certified that error appears in the above-identified patent and that said Letters Patent is hereby corrected as shown below:

2. A recording apparatus according to claim 1, wherein said restraining means is a projection extending from said holding means so that said recording head may be tilted in a sense closer to said second fitting means than said first fitting means by abutment of said recording head.

3. A recording apparatus according to claim 1, further comprising pressing means, at a position opposed to said projection, for pressing said recording head against said projection.

4. A recording apparatus according to claim 3, wherein said projection lies out of contact with said recording head in a state where said recording head is positioned at a predetermined position of said holding means.

5. A recording apparatus according to claim 2, wherein said projection lies out of contact with said recording head in a state where said recording head is positioned at a predetermined position of said holding means.

6. A recording apparatus according to claim 1, wherein said restraining means comprises urging means for urging said recording head toward said second fitting means.

7. A recording apparatus according to claim 1, further comprising:
a carriage for carrying said recording head thereon;
coupling means for coupling said recording head at a predetermined replacement position of said holding means; and
electrical contact means for transmitting an electric signal to said recording head upon making contact with an electrical contact surface of said recording head mounted on said carriage,
wherein said coupling means comprises a holding member for holding said recording head to move in a predetermined direction to place said positioning means and said recording head to be contacted and cause said recording head to be mounted on said carriage, and said holding member comprises an arm for detachably holding said recording head, and a positioning member of placing said recording head at a predetermined position on said holding member.

8. A recording apparatus according to claim 7, wherein the movement direction of said holding means is perpendicular to a direction of mounting said recording head.

9. A recording apparatus according to claim 7 or 8, further comprising means for covering said contact means and said positioning means from the direction of mounting said recording head.

10. A recording apparatus according to claim 9, further comprising pressure means, provided on a plane of said carriage opposed to said contact means and said positioning means, for pressing said recording head in a predetermined direction.

11. A recording apparatus according to claim 10, further comprising pressure means, provided on a plane of said carriage opposed to said contact means and said positioning means, for pressing said recording head in a predetermined direction.

It is certified that error appears in the above-identified patent and that said Letters Patent is hereby corrected as shown below:

12. A recording apparatus according to claim 11, wherein said pressure means comprises a plurality of pressure means including rigid pressure means and elastic pressure means.

13. A recording apparatus according to claim 10, wherein said pressure means comprises a plurality of pressure means including rigid pressure means and elastic pressure means.

14. A recording apparatus according to claim 7 or 8, further comprising pressure means, provided on a plane of said carriage opposed to said contact means and said positioning means, for pressing said recording head in a predetermined direction.

15. A recording apparatus according to claim 14, further comprising pressure means, provided on a plane of said carriage opposed to said contact means and said positioning means, for pressing said recording head in a predetermined direction.

16. A recording apparatus according to claim 15, wherein said pressure means comprises a plurality of pressure means including rigid pressure means and elastic pressure means.

17. A recording apparatus according to claim 14, wherein said pressure means comprises a plurality of pressure means including rigid pressure means and elastic pressure means.

18. A recording apparatus according to claim 7, wherein said positioning means corresponding to a positioning fit hole provided on said recording head is a tapered fit pin having a predetermined fit dimension at a positioning site of said recording head.

19. A recording apparatus according to claim 18, further comprising means for contacting a part of the fit hole for said recording head on a taper plane of said tapered fit pin.

20. A recording apparatus according to claim 7, wherein said holding means includes guide means for attaching said recording head to said holding means and restraining means for restraining the positional deviation from said attaching position.

21. A recording apparatus according to claim 7, wherein the width of said contact means is smaller in a direction of a signal line toward the top end.

22. A recording apparatus according to claim 7, wherein said contact means has a flexible substrate with an engagement portion provided at the top end of said flexible substrate, and a slit for inserting and engaging said engagement portion at the top end is provided on said coupler means or said contact means.

23. A recording apparatus according to claim 22, wherein the top end of said flexible substrate is movable in a direction of inserting said slit.

24. A recording apparatus according to claim 7, wherein a guide portion and a restraining portion corresponding to guide means and restraining means of said coupler means are provided on said recording head.

25. A recording apparatus according to claim 24, wherein said guide means opposed to said recording head has a recording medium conveying guide plane contacting with said recording medium, and is formed with at least one recess portion in an area on said recording medium conveying guide plane opposed to a replacement position along said main scan direction.

It is certified that error appears in the above-identified patent and that said Letters Patent is hereby corrected as shown below:

26. A recording apparatus according to claim 25, wherein said replacement position is within a printing area of the recording medium.

27. A recording apparatus according to claim 25, wherein said recording head is opposed to said recording medium conveying guide plane of said guide means and has a top end face formed with a step, the height of said step being greater than the depth of said recess portion formed on said recording medium conveying guide plane.

28. A recording apparatus according to claim 27, wherein the width of said recess portion on said recording medium guide plane is greater than the width of said top end face of said recording head plus the movement amount of said recording head in a predetermined direction required to separate said recording head from said carriage.

29. A recording apparatus according to claim 25, wherein said recess portion is formed concavely by at least two ribs among the ribs protruded along said conveying direction on said recording medium conveying guide plane and arranged at a predetermined interval, and a region on said recording medium conveying guide plane between said at least two ribs.

30. A recording apparatus according to claim 25, wherein said recess portion is formed concavely with said suction means as the bottom portion by forming a through hole on said recording medium conveying guide plane and disposing suction means for sucking the ink through said through hole.

31. A recording apparatus according to claim 7, wherein a moving direction of said coupling means is a moving direction of said carriage.

38. An ink tank used in said recording apparatus according to claim 37, wherein said ink tank is provided with a guide member for guiding said head cartridge and removably mounted on a head holder of said recording apparatus and a positioning member for removably positioning said head cartridge in a predetermined position within said head holder, said guide member being provided at least on a side of said ink tank.

39. A recording apparatus using said ink tank according to claim 38, wherein a face surface of said recording head has a member fittable with said positioning member provided on said head holder.

40. A recording apparatus having an arrangement according to claim 1, wherein a face surface of said recording head has a member fittable with said positioning member provided on said head holder.

41. A recording apparatus according to claim 1, wherein a direction normal to said surface is inclined with respect to said positioning direction at an angle approximately in the range 1° to 4°.

42. A recording apparatus according to claim 1, wherein part of said first fitting means has a cylindrical shape.

43. A recording apparatus according to claim 1, wherein said first fitting means has a square fit hole and said second fitting means has a round fit hole.

It is certified that error appears in the above-identified patent and that said Letters Patent is hereby corrected as shown below:

44. A recording apparatus comprising:

holding means for detachably holding a recording head for forming an image on the recording medium;

positioning means for positioning said recording head at a predetermined position of said holding means in mounting said recording head on said holding means, said positioning means having a first fitting means for restraining said recording head in a first direction and a second fitting means for restraining said recording head in a second direction; and restraining means for fitting said second fitting means prior to said first fitting means in mounting said recording head on said holding means is provided, wherein said first fitting means and said second fitting means are located on a surface not perpendicular to a positioning direction after fitting, said second fitting means is a columnar member projecting in a fitting direction to position said head with respect to said surface in the fitting direction, and said first fitting means is a positioning member projecting in the fitting direction to position said head with respect to rotation about an axis extending from said second fitting means in the fitting direction.

45. A recording apparatus according to claim 44, wherein said recording head is an ink jet recording head performing recording by discharging ink.

46. A recording apparatus according to claim 44, wherein said recording head is an ink jet recording head having an electrothermal converting member for generating thermal energy and discharging ink to record utilizing the thermal energy.

47. A recording apparatus according to claim 44, further comprising:

a carriage for carrying said recording head thereon;

coupling means for coupling said recording head at a predetermined replacement position of said holding means; and electrical contact means for transmitting an electric signal to said recording head upon making contact with an electrical contact surface of said recording head mounted on said carriage, wherein said coupling means comprises a holding member for holding said recording head to move in a predetermined direction to place said positioning means and said recording head to be contacted and cause said recording head to be mounted on said carriage, and said holding member comprises an arm for detachably holding said recording head, and a positioning member of placing said recording head at a predetermined position on said holding member.

48. A recording apparatus according to claim 47, wherein said recording head is an ink jet recording head performing recording by discharging ink.

49. A recording apparatus according to claim 47, wherein said recording head is an ink jet recording head having an electrothermal converting member for generating thermal energy and discharging ink to record utilizing the thermal energy.

50. A recording apparatus according to Claim 44, further comprising pressing means, at a position opposed to said projection, for pressing said recording head against said projection.

It is certified that error appears in the above-identified patent and that said Letters Patent is hereby corrected as shown below:

51. A recording apparatus according to Claim 50, wherein said projection lies out of contact with said recording head in a state where said recording head is positioned at a predetermined position of said holding means.

52. A recording apparatus comprising:
holding means for detachably holding a recording head for forming an image on the recording medium; and
positioning means for positioning said recording head at a predetermined position of said holding means in mounting said recording head on said holding means, said positioning means having a first fitting means for restraining said recording head in a first direction and a second fitting means for restraining said recording head in a second direction, said first fitting means and said second fitting means being located on a surface not perpendicular to a positioning direction after fitting, said second fitting means being a columnar member projecting in a fitting direction to position said head with respect to said surface in the fitting direction, and said first fitting means being a positioning member projecting in the fitting direction to position said head with respect to rotation about an axis extending from said second fitting means in the fitting direction.

53. A recording apparatus according to Claim 52, wherein a direction normal to said surface is inclined with respect to said positioning direction at an angle approximately in the range of 1° to 4°.

54. A recording apparatus according to Claim 52, further comprising pressing means at a position opposed to said projection, for pressing said recording head against said projection.

55. A recording apparatus according to Claim 52, wherein said projection lies out of contact with said recording head in a state where said recording head is positioned at a predetermined position of said holding means.

56. A recording apparatus according to Claim 52, wherein said recording head is an ink jet recording head performing recording by discharging ink.

57. A recording apparatus according to Claim 52, wherein said recording head is an ink jet recording head having an electrothermal converting member for generating thermal energy and discharging ink to record utilizing the thermal energy.

58. A recording head removably mounted on a recording apparatus comprising holding means for detachably holding a recording head for forming an image on the recording medium, and positioning means for positioning said recording head at a predetermined position of said holding means in mounting said recording head on said holding means, said positioning means having a first fitting means for restraining said recording head in a first direction and a second fitting means for restraining said recording head in a second direction, said first fitting means and said second fitting means being located on a surface not perpendicular to a positioning direction after fitting, said second fitting means being a columnar member projecting in a fitting direction to position said head with respect to said surface in the fitting direction, and said first fitting means being a positioning member projecting in the fitting direction to position said head with respect to said second fitting means in the fitting direction, said recording head having:
a first recess engageable with said first fitting means,
a second recess engageable with said second fitting means, and
a surface on which said first and second recesses are located, said surface corresponding to said surface on the side of said positioning means and not being perpendicular to said positioning direction.

It is certified that error appears in the above-identified patent and that said Letters Patent is hereby corrected as shown below:

59. A recording head according to Claim 58, wherein a direction normal to said surface is inclined with respect to said positioning direction at an angle approximately in the range of 1° to 4°.

60. A recording head according to Claim 58, further comprising pressing means at a position opposed to said projection, for pressing said recording head against said projection.

61. A recording head according to Claim 58, wherein said projection lies out of contact with said recording head in a state where said recording head is positioned at a predetermined position of said holding means.

62. A recording head according to Claim 58, wherein said recording head is an ink jet recording head performing recording by discharging ink.

63. A recording head according to Claim 58, wherein said recording head is an ink jet recording head having an electrothermal converting member for generating thermal energy and discharging ink to record utilizing the thermal energy.

64. A head cartridge integrally having an ink retaining portion and a recording head, removably mountable on a recording apparatus comprising holding means for detachably holding a recording head for forming an image on the recording medium, and positioning means for positioning said recording head at a predetermined position of said holding means in mounting said recording head on said holding means, said positioning means having a first fitting means for restraining said recording head in a first direction and a second fitting means for restraining said recording head in a second direction, said first fitting means and said second fitting means being located on a surface not perpendicular to a positioning direction after fitting, said second fitting means being a columnar member projecting in a fitting direction to position said head with respect to said surface in the fitting direction, and said first fitting means being a positioning member projecting in the fitting direction to position said head with respect to rotation about an axis extending from said second fitting meas in the fitting direction, said head cartridge having:

a first recess engageable with said first fitting means, a second recess engageable with said second fitting means, and a surface on which said first and second recesses are located, said surface corresponding to said surface on the side of said positioning means and not being perpendicular to said positioning direction.

65. A head cartridge according to Claim 64, wherein a direction normal to said surface is inclined with respect to said positioning direction at an angle approximately in the range of 1° to 4°.

66. A head cartridge according to Claim 64, further comprising pressing means at a position opposed to said projection, for pressing said recording head against said projection.

UNITED STATES PATENT AND TRADEMARK OFFICE

CERTIFICATE OF CORRECTION

PATENT NO. : 6,113,215
DATED : September 5, 2000
INVENTOR(S) : Yanagi et al.

It is certified that error appears in the above-identified patent and that said Letters Patent is hereby corrected as shown below:

67. A head cartridge according to Claim 64, wherein said projection lies out of contact with said recording head in a state where said recording head is positioned at a predetermined position of said holding means.

68. A head cartridge according to Claim 64, wherein said recording head is an ink jet recording head performing recording by discharging ink.

69. A head cartridge according to Claim 64, wherein said recording head is an ink jet recording head having an electrothermal converting member for generating thermal energy and discharging ink to record utilizing the thermal energy.

Signed and Sealed this

Seventeenth Day of June, 2003

JAMES E. ROGAN
*Director of the United States Patent and Trademark Office*